US008746585B2

(12) United States Patent
Harwood et al.

(10) Patent No.: US 8,746,585 B2
(45) Date of Patent: Jun. 10, 2014

(54) POWER TRIGGER SPRAYER

(75) Inventors: Michael R. Harwood, New Market, AL (US); James Richard Bullington, Athens, AL (US)

(73) Assignee: JM Harwood LLC, Huntsville, AL (US)

( * ) Notice: Subject to any disclaimer, the term of this patent is extended or adjusted under 35 U.S.C. 154(b) by 26 days.

(21) Appl. No.: 13/566,988

(22) Filed: Aug. 3, 2012

(65) Prior Publication Data

US 2013/0161409 A1 Jun. 27, 2013

Related U.S. Application Data

(63) Continuation-in-part of application No. 13/482,331, filed on May 29, 2012.

(60) Provisional application No. 61/580,650, filed on Dec. 27, 2011.

(51) Int. Cl.

| | |
|---|---|
| ***B05B 1/34*** | (2006.01) |
| ***B05B 9/04*** | (2006.01) |
| ***B05B 17/04*** | (2006.01) |
| ***B65D 88/54*** | (2006.01) |
| ***B67D 7/58*** | (2010.01) |

(52) U.S. Cl.
USPC ..... 239/11; 239/331; 239/332; 239/375; 239/463; 222/333; 222/383.1

(58) Field of Classification Search
USPC ..... 239/11, 329, 331, 332, 333, 375, 463, 239/488; 222/333, 383.1
See application file for complete search history.

(56) References Cited

U.S. PATENT DOCUMENTS

| | | | | |
|---|---|---|---|---|
| 3,993,250 | A * | 11/1976 | Shure | 239/332 |
| 4,197,884 | A | 4/1980 | Maran | 141/383 |
| 4,442,977 | A | 4/1984 | Beiswenger et al. | 239/322 |
| 5,150,841 | A * | 9/1992 | Silvenis et al. | 239/332 |
| 5,556,007 | A | 9/1996 | Breitsprecher | |
| 5,655,885 | A | 8/1997 | Chung | 417/44.2 |
| 5,662,271 | A | 9/1997 | Weston et al. | 239/321 |
| 5,716,007 | A | 2/1998 | Nottingham et al. | 239/332 |
| 6,116,472 | A | 9/2000 | Wanbaugh et al. | 222/340 |
| 6,554,211 | B1 | 4/2003 | Prueter et al. | 239/332 |
| 6,626,380 | B1 | 9/2003 | Williams et al. | |

(Continued)

OTHER PUBLICATIONS

Lefebvre, Atrhur H., "Gas Turbine Combustion", Hemisphere Publishing Corporation, pp. 389-398 , 1983.

(Continued)

*Primary Examiner* — Ryan Reis
(74) *Attorney, Agent, or Firm* — James Richards

(57) ABSTRACT

A power trigger sprayer comprising an integrated nozzle and pump assembly. The pump may comprise one or more pistons. Each piston feeds an input port of a swirl chamber spray nozzle. The nozzle is pulsed at a high rate, producing a predetermined spray pattern. In a further embodiment, the sprayer may be configured for handheld application of liquids and may comprise a tank for holding the liquid, a power source and control actuator together with the spray pump and nozzle in a hand operable unit. The sprayer may comprise a drip guard for directing drip flow away from the trigger and hand grip portion of the sprayer. The sprayer may include a battery within the hand grip portion. The battery may be in a battery module with grip/latch tabs allowing easy removal and replacement of the battery.

23 Claims, 36 Drawing Sheets

(56) References Cited

U.S. PATENT DOCUMENTS

| | | | | |
|---|---|---|---|---|
| 6,811,099 | B2 * | 11/2004 | Krestine et al. | 239/524 |
| 6,981,658 | B2 | 1/2006 | Streutker et al. | 239/337 |
| 7,066,406 | B2 * | 6/2006 | Williams et al. | 239/375 |
| 7,182,280 | B2 * | 2/2007 | Ye et al. | 239/526 |
| 7,318,539 | B2 * | 1/2008 | Vitantonio et al. | 222/333 |
| 7,467,752 | B2 | 12/2008 | Sweeton | 239/102.2 |
| 7,562,834 | B2 | 7/2009 | Hornsby et al. | 239/527 |
| 7,648,083 | B2 | 1/2010 | Hornsby et al. | 239/333 |
| 7,686,237 | B2 * | 3/2010 | Wanbaugh et al. | 239/528 |
| 7,766,194 | B2 | 8/2010 | Boll et al. | 222/333 |
| D623,958 | S | 9/2010 | Schaeffer et al. | D9/685 |
| 7,922,105 | B2 | 4/2011 | Zagorsky | 239/340 |
| D653,541 | S | 2/2012 | Foster et al. | D9/448 |
| D653,542 | S | 2/2012 | Arminak | D9/448 |
| D653,946 | S | 2/2012 | Arminak | D9/448 |
| D653,947 | S | 2/2012 | Arminak | D9/448 |
| D656,832 | S | 4/2012 | Bowers et al. | D9/526 |
| D660,941 | S | 5/2012 | Perez et al. | D23/225 |
| D660,942 | S | 5/2012 | Hudson et al. | D23/225 |
| D662,179 | S | 6/2012 | Lin | D23/225 |
| 2004/0099751 | A1 | 5/2004 | Krestine et al. | 239/302 |

OTHER PUBLICATIONS

Lefebvre, Arthur H., "Atomization and Sprays", CRC Press, 1989, pp. 112-118, 280-291.

PCTUS1342905 Search Report, Oct. 31, 2013, ISA/US.

* cited by examiner

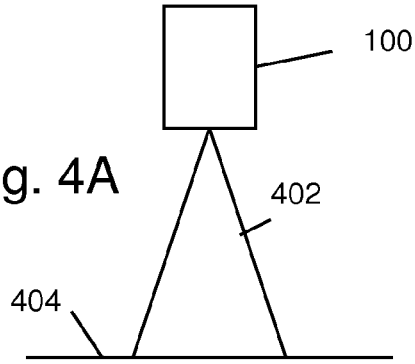
Fig. 4A
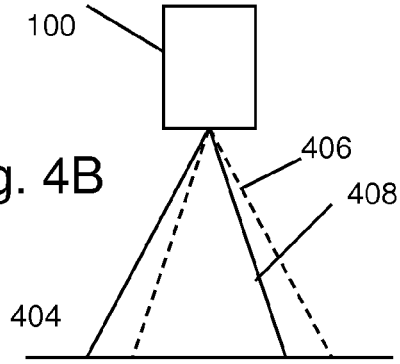
Fig. 4B
Fig. 4C
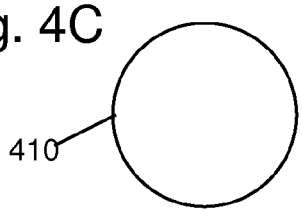
Fig. 4D
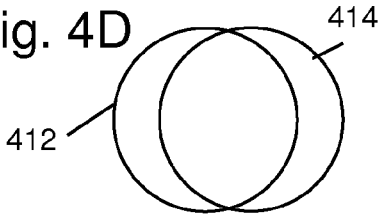
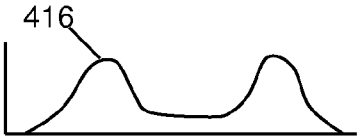
Fig. 4E
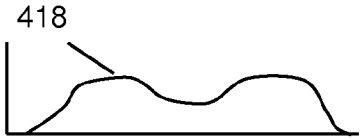
Fig. 4F
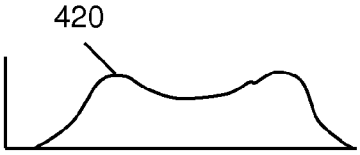
Fig. 4G
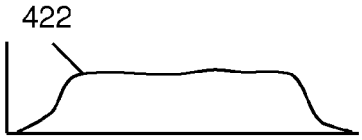
Fig. 4H Fig. 4I
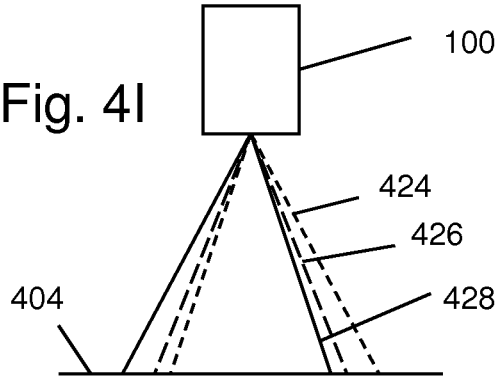
Fig. 4J
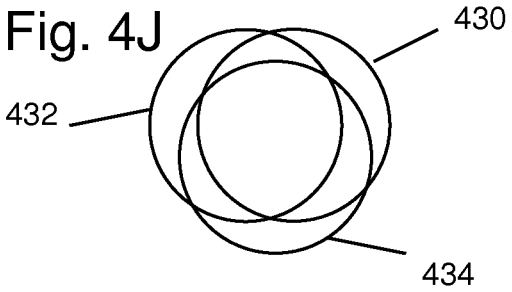
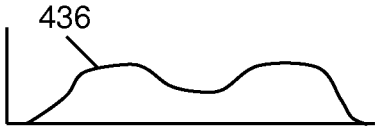
Fig. 4K
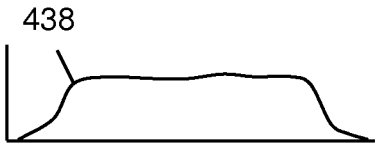
Fig. 4L

1800

POWER TRIGGER SPRAYER

RELATED APPLICATIONS

This application is a continuation in part of application Ser. No. 13/482,331 titled "Liquid Delivery System", filed May 29, 2012 by Harwood, which claims the benefit under 35 USC 119(e) of provisional application Ser. No. 61/580,650, Titled "Liquid Delivery System", filed 27 Dec. 2011 by Harwood. All of the above listed US Patent and Patent Applications are hereby incorporated herein by reference in their entirety.

FIELD OF THE INVENTION

The present invention pertains generally to the field of liquid delivery systems, more particularly to devices for powered airless spray delivery of liquids.

BACKGROUND OF THE INVENTION

Typical spray delivery systems include aerosol bottles, hand sprayers, and motorized and air driven paint sprayers. Aerosol bottles require special propellants and have environmental issues. Hand sprayers are typically limited to light liquids such as cleaning fluids that have a similar viscosity to water. Paint sprayers typically require a compressed air source or electric cord, making them too large and awkward for many applications. The aerosols and paint sprayers typically produce small droplet sizes that contribute to mists that degrade air purity and settle on undesired surfaces.

Prior art methods of spray delivery of viscous fluids may involve a high pressure gas to dropletize the flow. The gas flow turbulence acts to break up a low pressure liquid stream. Alternatively, two high pressure streams may be directed to impinge on one another from substantially opposite directions to break up the flow into droplets. These and other techniques for spraying viscous liquids typically result in a fine mist or undesired spray patterns. The fine mist may be desired in some paint spray operations, but can cause problems in other applications where the delivery must be confined to a target area and mists that may be carried by ambient air currents must be minimized.

Thus, there is a need for improvements in the art of spray delivery of high viscosity liquids.

BRIEF DESCRIPTION OF THE INVENTION

Briefly, the invention relates to a power trigger sprayer comprising an integrated nozzle and pump assembly. The pump may comprise one or more pistons. Each piston feeds an input port of a swirl chamber spray nozzle. The nozzle is pulsed at a high rate, producing a predetermined spray pattern. In a further embodiment, the sprayer may be configured for handheld application of liquids and may comprise a tank for holding the liquid, a power source and control actuator together with the spray pump and nozzle in a hand operable unit. The sprayer may comprise a drip guard for directing drip flow away from the trigger and hand grip portion of the sprayer. The sprayer may include a battery within the hand grip portion. The battery may be in a battery module with grip/latch tabs allowing easy removal and replacement of the battery.

In one variation, the sprayer pistons have a top cap for contact interface with the intermediate plate. The piston top cap may have a flat surface for contact with the intermediate plate to minimize contact pressure and resulting wear. The underside of the piston cap may have a spherical contact with the piston. One or more sliding interfaces between parts including the wobble plate hub, intermediate plate, piston cap, piston, and/or cylinder block may comprise two different materials, for example, two different plastics, for example nylon and acetyl, for example, DELRIN®. In one variation, a corrosion resistant metal, for example stainless steel, in particular, for example NITRONIC-60®, may be used for elements in contact with corrosive fluids.

In another variation, the pump may include a freely rotating contact member for coupling the pistons to the wobble plate. The contact member may be allowed to freely rotate coaxially with an associated piston to minimize friction and wear at the contact point with the wobble plate. The contact member may have a conical contact end for contacting the wobble plate. In a further variation, the contact member may be rigidly coupled to the piston and the piston may also be freely rotatable to minimize friction at the wobble plate contact point.

The contact member may be disposed within a non-rotating sleeve of TEFLON® or other low friction material and may be spring loaded against the wobble plate by spring force acting through the non-rotating sleeve.

In a further variation, the pump delivers a pulsating flow to the spray nozzle to better fill the interior of the coverage area of the spray pattern than traditional constant flow swirl nozzles.

In a further variation the sprayer may have an intermediate plate between the wobble plate and the pistons. The intermediate plate may be rotationally mounted on the wobble plate and allowed to rotate freely relative to the wobble plate.

In a further variation, the system may be configured for handheld application of liquids and may comprise a tank for holding the liquid, a power source and control actuator together with the spray pump and nozzle in a hand operable package.

In one application, the system may be configured for application of high viscosity liquids, such as vegetable cooking oils in a food preparation operation by matching the nozzle configuration and flow rate to produce a wide spray pattern with large enough droplet size to avoid undesirable mist formation. In one embodiment, the system meets a mist free criterion, for example: 90% of the flow volume comprises droplets that are large enough to settle in still air at 6 inches per second (15 cm/sec.), or preferably one foot per second (30 cm/sec.) or faster.

In one variation, the system delivers a filled circular spray pattern. The pattern may be measured at, for example 20 cm. The full width of the spray may be for example, 20 degrees for 90% containment. The fluid delivery may be for example from 1 ml/sec to 3 ml/sec for a fluid having an exemplary kinematic viscosity of 15 centiStokes or more.

The filled circular pattern may be achieved, at least in part, by operating the swirl nozzle at multiple flow rates. In one embodiment, the pump delivers pulses of flow distributed over a range of flow rates. For example, the pulse flow characteristic may be characterized as a half sine function delivering flow rates from zero to a maximum value. The flow characteristic may include at least two different non-zero flow rates. The width of the spray pattern may be a function of the flow rate. Thus the pattern distribution may be controlled by varying the flow rate.

In one variation, the flow is pulsed at a pulse repetition rate sufficient for an average high velocity flow from a following pulse to overtake an average low velocity flow from a preceding pulse before reaching a spray target. In one variation, the spray target may be at a distance of, for example, at least 20, or at least 30 centimeters. Average high velocity and average low velocity being the average flow above and below a 50% velocity.

In one variation, the pulse repetition rate is preferably between 2000 and 30,000 pulses per minute, preferably 14000 pulses per minute.

In one variation, the swirl chamber has a height to width ratio preferably between 0.4 and 0.6.

The swirl chamber output nozzle opening may be located in a recess and the nozzle initial cone angle may be greater than the spray initial cone angle to minimize drips.

In a further variation the sprayer may be configured in a hand held unit. The hand held unit may include a spray bottle source for the fluid. The hand held unit may further include a drip guard for directing any fluid drip in front of a space to be occupied by the hand in an operating configuration for the device. The space being within 2.5 cm or preferably within 2 cm of a trigger for operating the sprayer. The drip guard may form a lowest local point directly below the nozzle. The trigger guard satisfies several, self-conflicting constraints: (a) the guard forms the lowest point, (b) does not block access to the trigger, and hence, interfere with grapping the trigger during operation, and (c) remains close enough to the nozzle that the oil does not flow around the guard.

In a further variation of a hand held unit, the sprayer may include a battery configured to fit within a grip handle of the device and the unit may achieve a total spray "on" time of greater than one hour. The battery is contained within a plug-in battery module that may be removed and placed in a charger with a single continuous grip and place motion without releasing the grip until completed, and without removing the sprayer from the liquid source bottle.

In a further variation of a hand held unit, the sprayer may achieve a total spray volume of 1 liter or more, preferably greater than three liters on a single charge from the power source.

The invention further includes methods related to the features of the device including a method of spraying a viscous fluid.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

FIG. 4A-FIG. 4H illustrate various spray pattern effects.

FIG. 4I-FIG. 4L depict a three piston embodiment.

DETAILED DESCRIPTION OF THE INVENTION

Figure 1A:
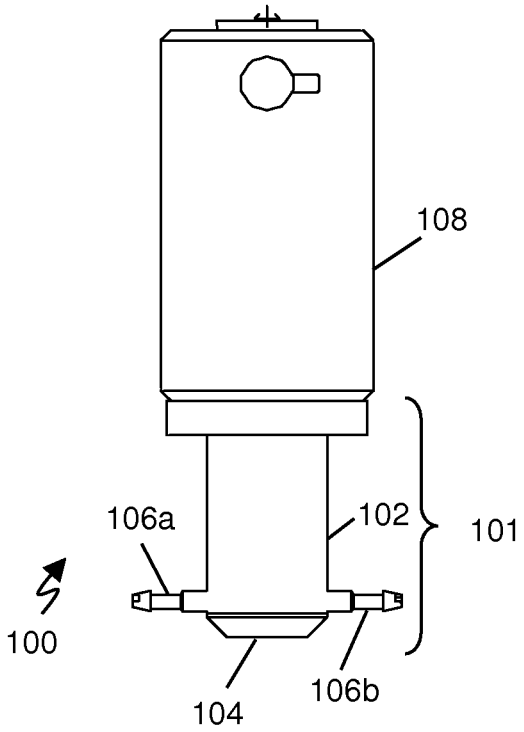
FIG. 1A-FIG. 1C illustrate an exemplary liquid delivery system in accordance with the present invention.

A sprayer in accordance with the present invention is capable of delivering a high performance spray pattern for an extended period of time from a light, compact, hand held, self contained, battery operated unit. The unit has advantages for spraying high viscosity and low volatility fluids, such as cooking oil and has advantages in a commercial high duty cycle environment. The unit is capable of self priming operation and includes a non-spill vent to prevent collapse of an attached container. The unit is adaptable for numerous different container attachments by exchanging a single part.

The sprayer achieves advantages in battery life and ease of use through a combination of an efficient sprayer coupled with a high capacity battery. The sprayer comprises ergonomic handle/spray head combination. The handle is configured for maximum battery compartment volume consistent with ease of use and handling in order to provide the largest battery practical to maximize spray time with a single charge. The handle is sized to be comfortable to hold and operate. Thus the size of the handle is limited and the size of the contained battery is limited. In one exemplary sprayer, the diameter of the grip is 1.75 in (4.4 cm), preferably between 1.5 in (3.8 cm) and 2 in (5 cm). The battery is fitted into the handle to occupy the maximum space fraction feasible allowing for manufacturability and economy. The battery 2004 is incorporated into the battery module 1822 to make the battery quickly and easily replaceable. In one embodiment, battery 2004 may be a battery assembly comprising three rechargeable lithium cells, each 3.7 volts and 880 mAH. Each cell may be 6 mm×30 mm×48 mm, making the three cells 18 mm×30 mm×48 mm. The battery assembly 2004 may also include charge balancing and protection components as well as a connector. The sprayer avoids the use of a battery appendage to increase battery capacity, as is often done in the power tool industry. A battery appendage would add weight to the sprayer and interfere with the operation of the sprayer.

A battery assembly is uniquely configured for one handed replacement without removing the bottle. The battery assembly may be removed from the unit by gripping two tabs accessible within finger recesses in the sprayer unit. The two tabs may be gripped with a single hand motion. The grip can remove the battery, hold the battery and transfer the battery to a charger in a single motion. A charged battery may be then gripped by the corresponding tabs, or otherwise, and slipped into the sprayer unit in a single motion. The battery is contained within the center of the grip/handle portion of the sprayer such that the battery is near the vertical center line and contributes to a centered center of gravity to minimize any tipping tendency that would result from an off center, out of balance position.

The sprayer has features providing advantages for high viscosity fluids. In particular, the nozzle end of the sprayer is adapted to minimize drip tendency by providing a wide angle nozzle exit to prevent interference with the spray pattern. Further, the lower side of the nozzle end is provided with a drip shield that is ahead of the finger grip and trigger area to direct any drip flow to form drops and drip without conducting the fluid to the hand grip, trigger and electrical switch area. One characteristic of high viscosity fluids, is a typical low volatility. Thus, any small flow left over from the spray does not evaporate as is typical with water based cleaners or paints. This flow may accumulate over multiple operations of the sprayer. The drip shield provides a low point for accumulation of this flow, where it may be easily wiped away or may drop, typically on a table or stand, rather than flow into the trigger area. As a further feature, the trigger is provided with a low point capable of accumulating fluid and preventing flow deeper into the sprayer, i.e., into the electrical switch compartment.

As a further feature, one embodiment of the sprayer may utilize an integrated motor, pump, nozzle assembly providing a high speed pulsating flow to a swirl chamber nozzle to efficiently provide a circular filled spray pattern when spraying viscous oil. A wobble plate pump drive yields a compact cylindrical form factor with a centered center of gravity, permitting compact, convenient, attractive packaging for the device.

FIGS. 1-17 illustrate various sprayer pump and nozzle concepts usable in the present invention. FIGS. 18-25 illustrate an exemplary sprayer system with further features and advantages for spraying fluids.

The present invention relates to an efficient integrated sprayer pump and nozzle assembly having numerous benefits serving numerous applications. The sprayer may be used with a wide range of liquids, including water, alcohol, numerous cleaners and cleaner solutions. In one application, the sprayer is well suited for spraying heavy oils, such as paints or other oils, in particular, for applying non-stick cooking oil in a food preparation facility. A problem with conventional sprayers of light weight fluids, when attempting to spray oils is that the nozzles fail to deliver a spray, but deliver an irregular stream instead. In addition, far more power is typically required to push the heavy oil through the nozzles. Conventional nozzle design typically ignores the viscosity property in the theoretical analysis. This works fine for water and other fluids with a kinematic viscosity near 1 centiStoke, but breaks down when the viscosity is more like 40 to 80 centiStokes like cooking oil. Alternatively, conventional sprayers may use high power to develop high pressures or mix with gas or air, as is done for typical paint sprayers. The result is a heavy sprayer requiring a plug in chord or a compressed air line for operation. Paint sprayers also typically deliver a fine mist that may be undesirable in food preparation, producing oil contamination distant from the work station and possibly producing a fire hazard.

When discussing cooking oils, kinematic and dynamic viscosity may be closely related and close in numeric value. Dynamic viscosity in centipoises (cP) may be determined by:

$$\text{Dynamic Viscosity (cP)} = \text{Kinematic Viscosity (cSt)} * \text{Density (g/mL)}.$$

Since the density (specific gravity) of typical cooking oil is about 0.92, a kinematic viscosity value of 80 cSt yields a dynamic viscosity value of 74 cP.

The present invention achieves numerous advantages that cooperate to yield a sprayer having a desirable spray pattern using heavy oil while requiring a low operational power. The sprayer achieves a small size, light in weight, thus enabling a battery operated, light weight, hand held, power sprayer for cooking oil. The sprayer delivers a desirable well contained spray cone with a filled circular pattern and a droplet size that avoids undesirable mists.

The sprayer's achievements may be attributed to the cooperation of one or more features described herein, including:

A swirl chamber nozzle having unconventional design and dimensions.

An efficient pump having a unique diagonal axis spinner plate/wobble plate drive to convert motor rotational drive to piston reciprocating motion.

The spinner plate drive detail allows area contact on friction surfaces to avoid point contact or line contact to minimize wear and promote long life.

The spinner plate/wobble plate drive allows orientation of pistons parallel to the motor axis yielding a compact linear form cooperating to yield a compact linear sprayer form factor.

The spinner plate/wobble plate configuration eliminates gear trains and provides compact unit for small size and light weight.

The functional partitioning of the integrated piston/cylinder/nozzle assembly permits ease of component manufacture and ease of assembly.

Dual piston pulse flow reduces/eliminates stationary flow time at the nozzle, mitigating drip/drool issues.

The sine function pulse flow delivered to the nozzle promotes a filled circular pattern.

The flow pulses are close coupled to the nozzle to avoid smoothing of the pulses.

Each piston is separately coupled to the swirl chamber from opposite sides to promote a more uniform spray pattern.

High speed rotation produces a high pulse rate, which further breaks up the flow and promotes a wider filled circular spray pattern.

High speed rotation produces a sufficiently high pulse rate that the flow is effectively continuous in operation.

The sprayer may be packaged into a cordless, hand held unit, which may be attached to a sprayer bottle for convenient hand-held operation.

The sprayer unit may include a battery and trigger for operating the sprayer.

The sprayer unit may include a drip guard to redirect drip flow away from the trigger and hand grip, while allowing quick access to a grip/handle portion of the sprayer for operation of the sprayer.

The sprayer battery may be located within a grip section and may be easily removable and replaceable.

The sprayer battery module may include grip/latch tabs that allow releasing the battery from the sprayer, removing the battery, and placing the battery in a charger using a single continuous grip and move operation without releasing the grip until completed.

These and further advantages and further features will be appreciated in light of the following detailed description with reference to the drawings.

Figure 1B:
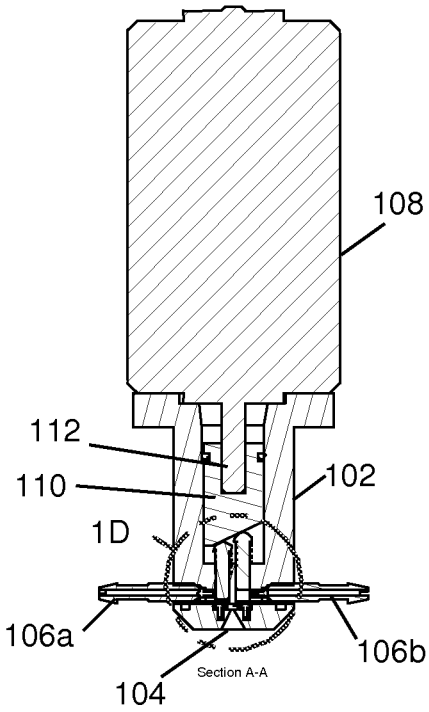
Figure 1C:
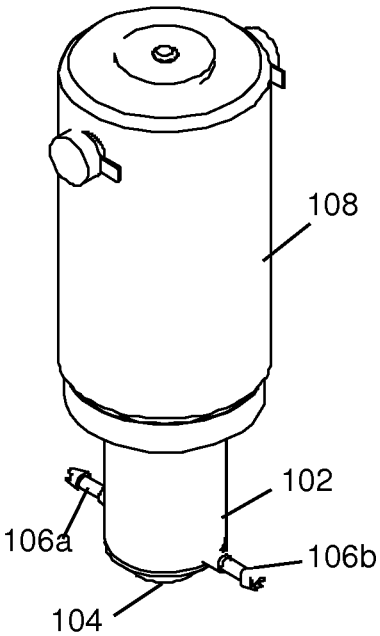

FIG. 1A-FIG. 1D illustrate an exemplary liquid delivery system 100 in accordance with the present invention. FIG. 1A is a side view. FIG. 1B is a cross section through FIG. 1A in the plane of FIG. 1A. FIG. 1C is an isometric view of the system of FIG. 1A. Referring to FIGS. 1A-1C, particularly FIG. 1B, the system comprises a motor 108 integrated with a pump section 101 containing a spray nozzle 104. The motor 108 drives a diagonal wobble plate 110. The wobble plate 110 drives two pistons through direct sliding contact with a diagonal surface 111 of the wobble plate 110, i.e., without an intervening non-rotating plate. The piston contact surfaces are beveled for maximum surface contact and minimum wear against the wobble plate. In this disclosure, a wobble plate drive refers generally to a reciprocating drive developed from a rotating diagonal plate referred to as a wobble plate, sometimes referred to as a swash plate.

Referring to FIG. 1A, FIG. 1A shows a pump assembly 100. The pump assembly comprises a motor 108 mounted to a pump housing 102 of a pump section 101. The pump housing 102 has two input ports 106*a* and 106*b*. The two input ports separately feed each of the two pistons. Alternatively, a single input port may feed both pistons. The outputs of the two pistons are combined at a single swirl spray nozzle 104.

FIG. 1B is a cross section of FIG. 1A showing additional detail. The motor shaft 112 drives a wobble plate 110. The wobble plate is a cylindrical section attached to the motor shaft 112 and rotating within a bore of the pump housing 102. The wobble plate has a diagonal face providing sinusoidal drive to two pistons. Alternatively, one or more pistons may be used. The wobble plate is shown with an O-ring seal to prevent migration of the pumped fluid to the motor.

FIG. 1C is an isometric view of the pump assembly of FIG. 1A.

Figure 1D:
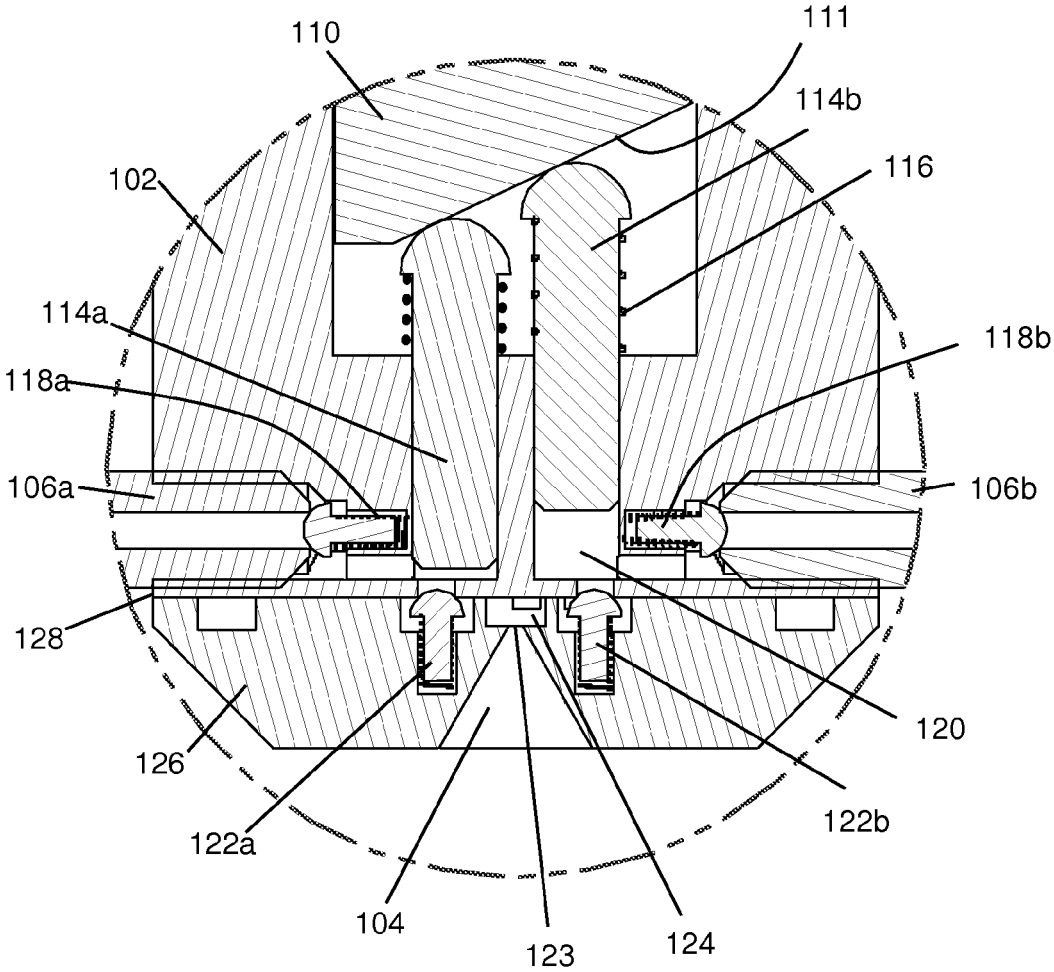
FIG. 1D is a magnified view of a portion of the cross section view of FIG. 1B.

FIG. 1D is a magnified view of a portion of the cross section view of FIG. 1B. FIG. 1D shows more clearly the pump and nozzle structure. The view shows the pump housing 102 and nozzle plate 126. The nozzle plate 126 forms the structures for the piston valve recesses flow passages from the pistons to the swirl chamber, the swirl chamber 124 itself, and the nozzle port 123 and nozzle cone 104. The pump housing 102 forms the piston cylinder and guide. The cylinder bore is not completely through, but bottoms in the pump housing leaving a wall for forming the outlet valve. The outlet valve seat is formed in the pump housing wall at the end of the cylinder.

An inlet port is provided in the cylinder side wall. In one embodiment the inlet port is at the top of the piston stroke. The inlet port may be covered and closed by the piston through the bottom of the stroke. This may permit the elimination of the inlet valve in one embodiment of the invention. FIG. 1D, however, shows an inlet valve between the inlet connection and the cylinder inlet port. FIG. 1D shows the pistons 114*a*, 114*b* spring loaded against the wobble plate 110.

In operation, the motor 108 rotates the wobble plate 110, which produces sinusoidal drive to the pistons 114*a*, 114*b*. Beginning at the top of a piston stroke, the piston 114*b* pushes downward, pressurizing the fluid. The pressurized fluid then forces open the outlet valve 122*a*, 122*b* and closes the inlet valve 118*a*, 118*b*. The fluid passes through the outlet valve recess and flow passage to the outer circumference of the swirl chamber 124, where the fluid is injected off center, producing a vortex action in the fluid as the fluid travels to the center nozzle outlet opening 123. Upon exit from the nozzle, the centrifugal component of fluid motion produces a conical spray pattern. The angle of the nozzle cone 104 is typically a wider angle than the spray pattern angle to avoid interference with the spray pattern.

As the piston returns from bottom to top, the outlet valve 122*a*, 122*b* closes, and a low pressure is produced in the cylinder chamber 120. As the piston uncovers the inlet port, the low pressure is transmitted to the inlet fluid, opening the inlet valve 118*a*, 118*b* and allowing fluid to enter the cylinder chamber 120.

By having a short direct rigid connection from the pistons to the swirl chamber, the pressure and flow fluctuations produced by the piston are coupled to the swirl chamber. This acts to vary the spray pattern width during the stroke and fill in the center of the pattern. With a constant flow, a hollow circular cross section pattern is produced. For some applications, the solid, filled in circular cross section produced by the pulsation may be preferred. By using two pistons 180 degrees out of phase in the configuration shown, each piston produces a separate independent pulse to the swirl chamber. Alternatively, by using four pistons 90 degrees out of phase (not shown), a more constant flow resulting from overlapping pulses would be presented to the swirl chamber.

One advantage of the invention is in the simplicity of the device. Only two housing parts are required, the pump housing 102 and the nozzle plate 126. Many of the chambers, passages, valve seats and components may be formed in these parts. The housing is a two part housing with a single separation plane 128. The two parts may be joined with a gasket or o-rings to prevent leakage. The housing chambers and features may be cast or machined into the housing parts. The arrangement allows for the forming of all of the features of the part by the mold being pulled apart with few or no sliders coming in from the side or other mechanized mold parts. The arrangement also requires little or no secondary machining operations.

Figure 2A:
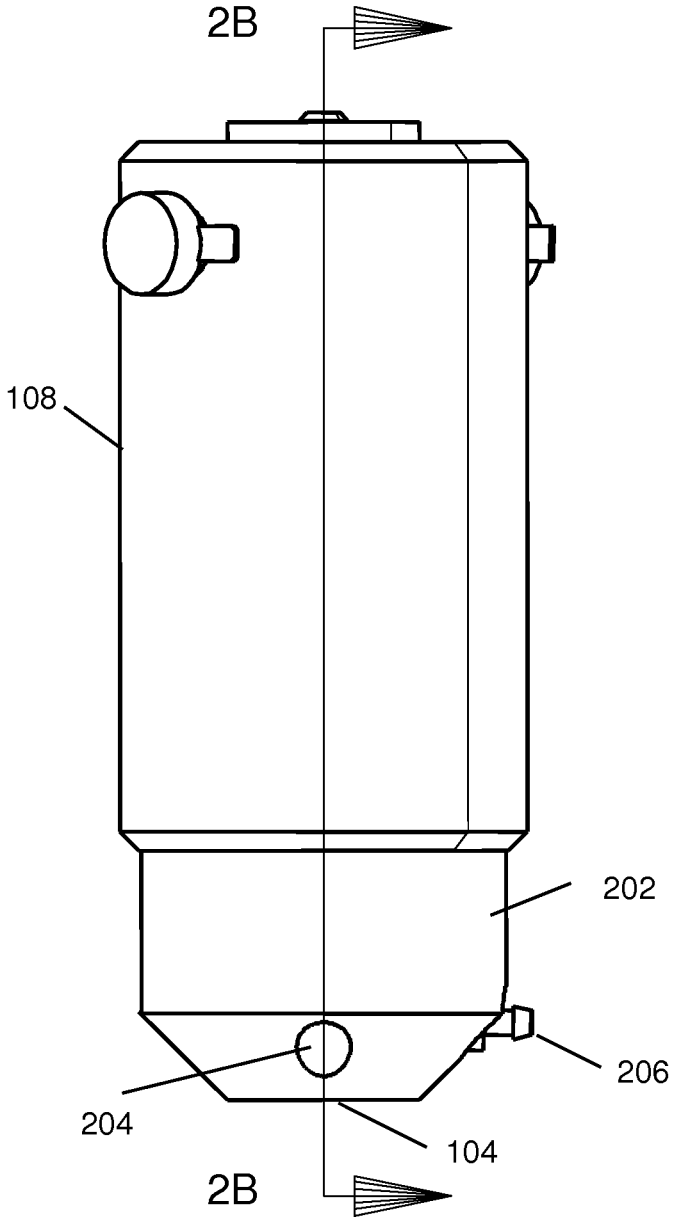
FIG. 2A is a side view of a second embodiment of the invention.

FIG. 2A is a side view of a second exemplary embodiment of the invention. FIG. 2A shows a motor 108, pump housing 202, inlet port 206, nozzle 104 and mounting screw recess 204.

Figure 2B:
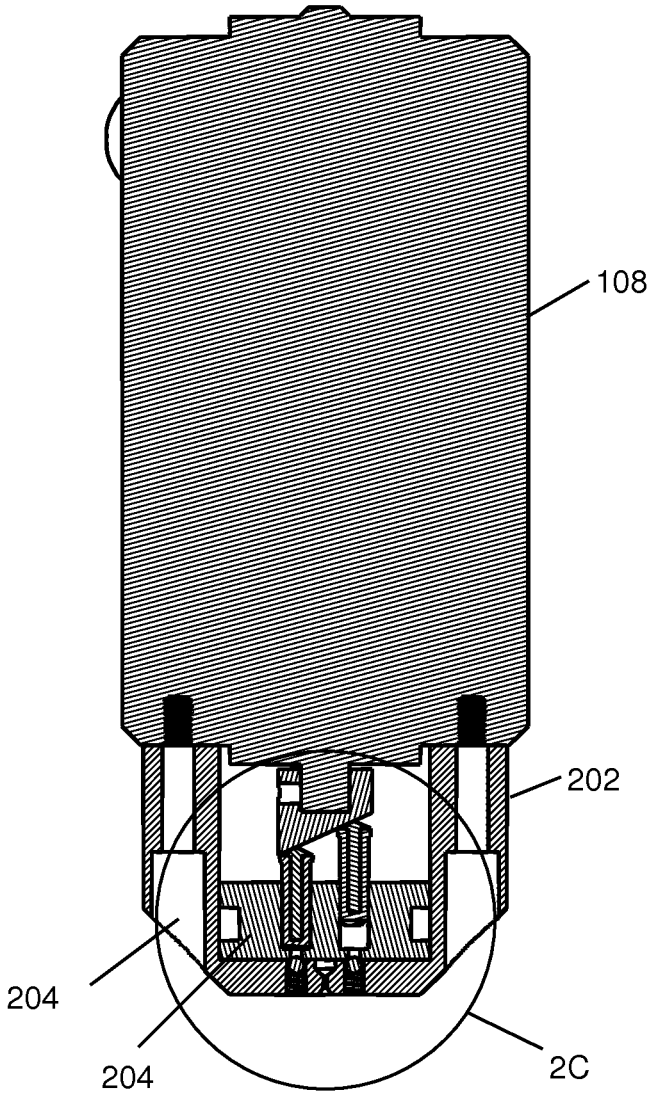
FIG. 2B is a cross section view of the embodiment of FIG. 2A.

FIG. 2B is a cross section view of the embodiment of FIG. 2A. The pump of FIG. 2B comprises two structural components, the pump housing 202 and a cylinder insert 210. The pump housing 202 forms a single continuous outer shell of the pump assembly, thus minimizing the chances for external leaks.

Figure 2C:
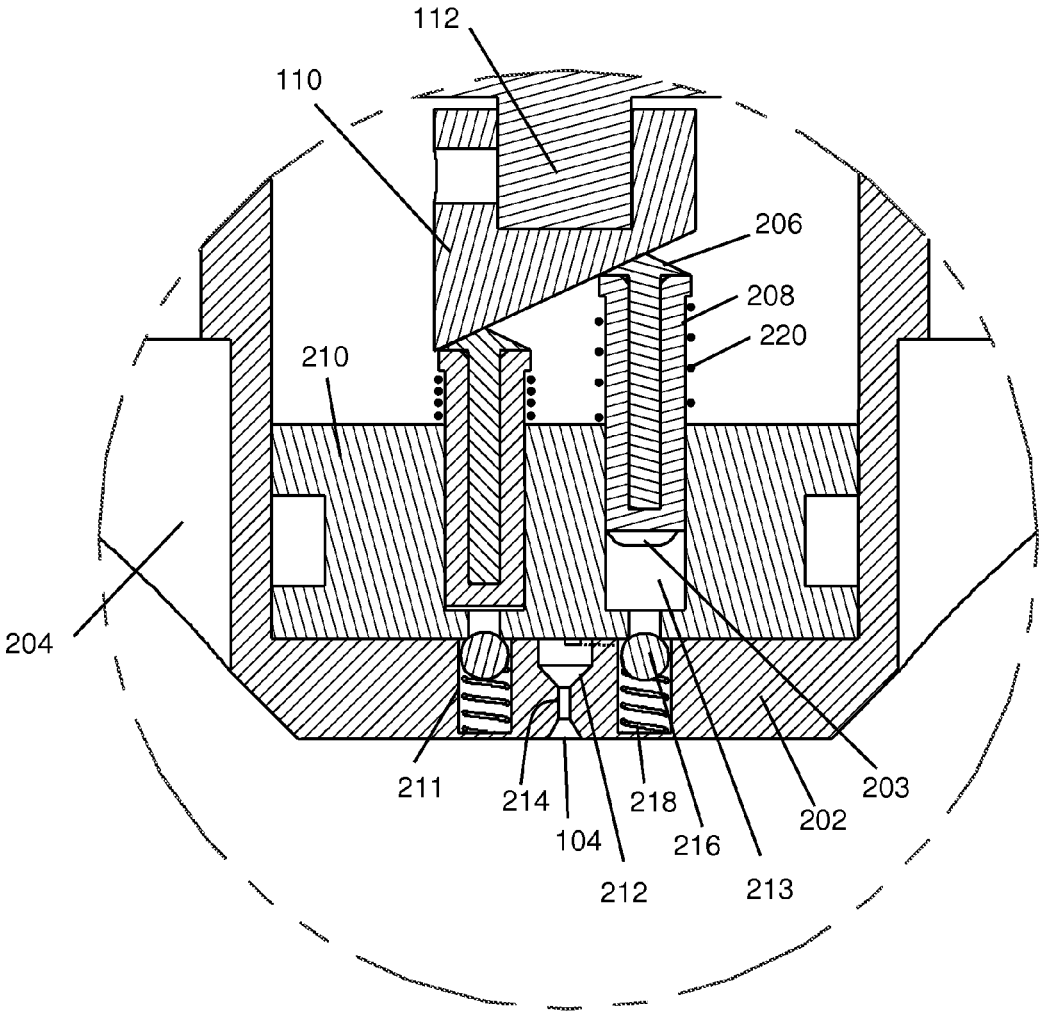
FIG. 2C is a magnified view of a portion of the cross section of FIG. 2B.

FIG. 2C is a magnified view of a portion of the cross section of FIG. 2B. FIG. 2C shows the motor shaft 112 and wobble plate 110. The wobble plate 110 is coupled to two pistons 208 operating in cylinder recesses formed in the piston insert 210. The piston insert includes piston cylinders. The cylinders are not drilled through, but have a bottom wall in which the outlet valve seat is formed. The pump housing 202 includes the swirl chamber 212, nozzle 214, cone 104, valve recesses 209, and feed channels leading from the valve recesses 219 to the swirl chamber 212. (The feed channels are not visible in this cross section—see FIG. 3B 304.)

The nozzle of FIG. 2C illustrates alternative features relative to the nozzle of FIG. 1D. A tapered bottom of the swirl chamber is shown and a non-zero length for the nozzle throat 214 is shown. Note also the ball valve 216 used in FIG. 2C. The spring loaded ball may represent a lower cost alternative.

FIG. 2C also shows the elimination of the input valve by placing the input port 203 at the top of the piston stroke. In operation, the piston 208 first travels from top to bottom. As the piston passes the input port 203, the piston covers and closes the input port 203. Further travel toward the bottom forces the fluid out through the outlet valve 216. Upon retracing from bottom to top, the outlet valve 216 closes and the piston 208 creates a vacuum in the cylinder chamber 213. When the piston 208 reaches and uncovers the input port 203, fluid is allowed to enter, drawn in by the vacuum in the cylinder 213.

FIG. 2C also illustrates a piston variation allowing lower friction and wear against the wobble plate. The piston comprises a non-rotating outer shell 208 and a rotating inner cap pin 206. The inner cap pin 206 is in operative contact with the wobble plate 110. The outer shell 208 may be a low friction material, for example but not limited to TEFLON®, acetyl (DELRIN®), nylon, also metallic materials, for example steel, stainless steel, NITRONIC-60®. The inner cap pin 206 may be metallic. The top surface of the cap pin may have a conical shape or slightly convex curved conical shape to maximize the contact area between the wobble plate and the cap pin. The cap pin and outer shell are generally cylindrical in shape coaxially aligned with the cylinder. The outer shell acts as a piston within the pump cylinder. The cap pin is allowed to rotate as a cylindrical bearing within the outer shell. The outer shell may be allowed to rotate within the piston cylinder bore, but may preferably be rotationally restrained by contact with the return springs 220.

Figure 3A:
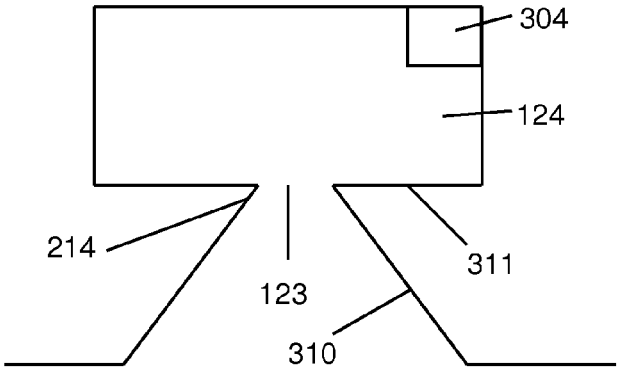
FIG. 3A, FIG. 3B, and FIG. 3C are outline drawings showing the features of the nozzle structure.
Figure 3B:
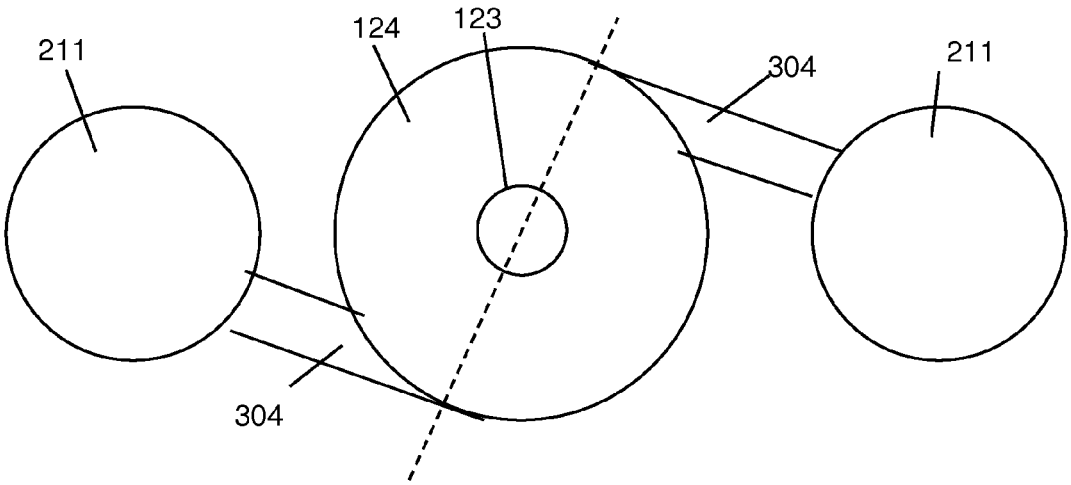
Figure 3C:
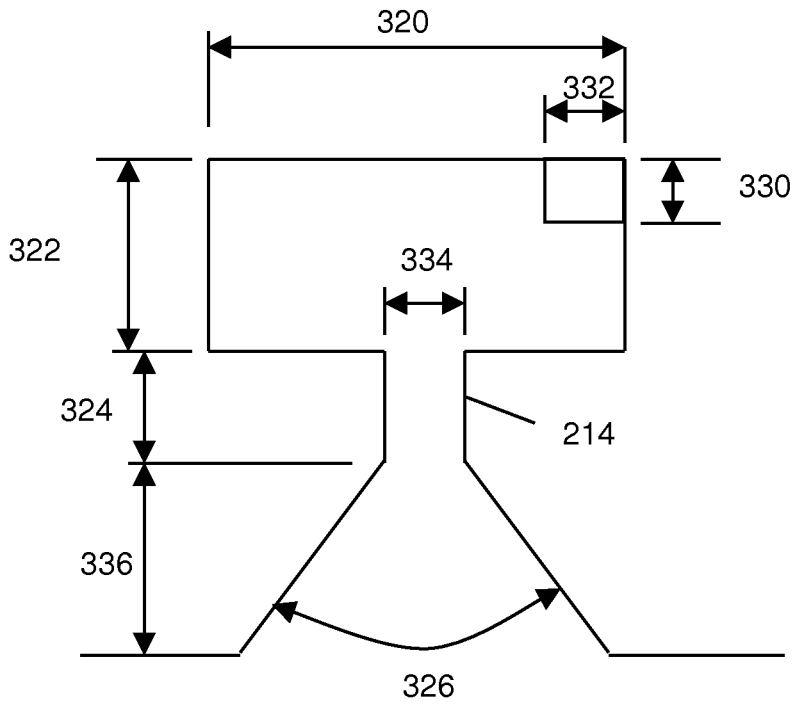

FIG. 3A, FIG. 3B, and FIG. 3C are outline drawings showing the features of the exemplary nozzle structure. FIG. 3A is a side view of an exemplary nozzle. FIG. 3A shows a side view of a swirl chamber 124, injection channel 304, nozzle 123, nozzle throat 214, nozzle flare 310.

FIG. 3B shows a top view of the nozzle of FIG. 3B further including valve recesses. FIG. 3B shows the swirl chamber 124, injection channels 304, valve outlet port 123 and valve recesses 211. The valve recesses 211 house the valve springs 218 and ball 216 (FIG. 2C). Fluid flows from the pistons into the valve recess 211, then from the valve recess through the injection channel 304 to the swirl chamber 124. The injection channel 304 preferably injects the flow into the top of the swirl chamber 124 directed tangentially to the swirl chamber circumference. The flow forms a vortex flow in the swirl chamber 124 and exits through the nozzle 123.

FIG. 3C shows typical exemplary dimensions for the nozzle of FIG. 3A. The nozzle of FIG. 3A has particular advantages for spraying high viscosity fluids, for example, cooking oil. Referring to FIG. 3C, FIG. 3C shows the swirl chamber diameter 320, swirl chamber height 322, feed channel height 330, feed channel width 332, outlet port (nozzle) diameter 334, nozzle throat length 324, flare angle 326 and flare length 336.

FIG. 3C shows a flat rather than tapered or conical bottom surface 311 for the swirl chamber. A typical low viscosity swirl chamber may utilize a conical (not shown) bottom leading to the nozzle 123. For high viscosity fluids, a flat bottom surface may be preferred, and the ratio of swirl chamber height to diameter should preferably be about 0.5. For viscous fluids, a short swirl chamber, with a height to diameter of less than 0.3 loses too much swirl to viscous losses, as does a narrow swirl chamber with a height to diameter ration of greater than 0.7. Thus, the preferred range of height to diameter is 0.3 to 0.7, more preferably 0.4 to 0.6 and more preferably 0.45 to 0.55. A typical exemplary swirl chamber dimension may be 0.050 in height and 0.100 in diameter. The outlet port 123 may be 0.020 in diameter.

In one variation, the ratio of the diameter of the swirl chamber 320 to the diameter of the nozzle 334 may be from 0.15 to 0.25, preferably 0.2.

The throat 214 may not exist, i.e., may have a zero length. For high viscosity fluids the transition from swirl chamber to nozzle cone may preferably be a sharp angle transition as shown in FIG. 3A. Any length of the throat contributes to viscous damping of the fluid rotation; however, practical construction considerations may require a short length 324. Length 324 of the throat 214 should preferably be small in relation to the width of the nozzle/throat 334, for example, equal or less than 0.25 times the width 334.

An exemplary throat length 324 may be 0.027 in, although for high viscosity fluids the throat length may be preferably zero. An exemplary conical angle may be +– 60 degrees. In addition, the swirl chamber preferably includes no chamfers at the joining of the bottom and top walls with the cylinder or in the formation of the injection channels 304.

The nozzle dimensions and flow rate can be varied to produce a variety of spray patterns and droplet sizes. In one exemplary embodiment, the system may deliver a spray pattern 4 inches (100 mm) wide at 12 inches (30 cm). In another embodiment the spray pattern may be 12 inches (30 cm) wide at 14 inches (35 cm) distance.

Table 1 shows exemplary nozzle dimensions (inches) associated with FIG. 3C.

TABLE 1

| Dimension Nozzle | 320 | 334 | 322 | 324 | 332 | 330 |
|---|---|---|---|---|---|---|
| 1 | 0.100 | 0.020 | 0.100 | 0.027 | 0.022 | 0.022 |
| 2 | 0.100 | 0.020 | 0.050 | 0.000 | 0.022 | 0.022 |
| 3 | 0.100 | 0.015 | 0.037 | 0.000 | 0.022 | 0.022 |
| 4 | 0.075 | 0.015 | 0.035 | 0.000 | 0.022 | 0.022 |
| 5 | 0.084 | 0.017 | 0.042 | 0.000 | 0.022 | 0.022 |
| 6 | 0.100 | 0.020 | 0.050 | 0.000 | 0.022 | 0.022 |

Dimension 320 is the diameter of the swirl chamber 124.

Dimension 334 is the diameter of the nozzle opening 123 from the swirl chamber 124.

Dimension 322 is the height of the swirl chamber 124.

Dimension 324 is the length of the nozzle throat 214. In one variation the length may be zero, or effectively zero, less than one tenth the diameter of the nozzle 334. Preferably, the cone may form a knife edge with the bottom of the swirl chamber.

Dimensions 322 and 330 are the height and width of the fluid transfer channel 304 from the valve wells 211 to the swirl chamber 124.

Dimension 326 is the angle of the nozzle cone. The angle is typically larger than the spray pattern cone angle to avoid interference with the spray pattern. In one variation, the nozzle cone may be optional, i.e., the angle may be 180 degrees full width.

Dimension 336 is the length of the nozzle cone. The length is typically governed by any thickness necessary to provide supporting structure to the pump or pump structures, for example the outlet valve wells 211 (also referred to as valve recesses 211.)

FIG. 4A-FIG. 4H illustrate various spray pattern effects. FIG. 4A shows a hollow cone spray pattern as may be produced by a swirl nozzle fed by a steady flow from a single injection channel. FIG. 4A shows a sprayer 100 with nozzle. Boundary lines 402 depict the spray pattern as the sprayer sprays a fluid onto a surface 404. FIG. 4B illustrates a dual cone spray pattern as produced by the dual feed point alternating drive swirl nozzle. When the sprayer 100 is driven by a single offset feed channel, the swirl is slightly asymmetrical and produces an offset cone spray pattern with the center of the cone slightly offset from the centerline of the sprayer. With two feed channels driving from opposite sides as shown in FIG. 3B, and when each feed channel is driven alternately with non simultaneous, non overlapping pulses, each feed channel generates an oppositely offset cone pattern, viz., the right pattern 406 and left pattern 408 shown in FIG. 4B. FIG. 4C shows a top view of the single spray pattern of FIG. 4A. The circle indicates the locus of greatest spray density. A circular spray pattern refers to a pattern with an equal density contour containing 90% of the spray with at least a two to one major diameter to minor diameter ratio, preferably at least a 1.5 to one major diameter to minor diameter ratio. FIG. 4D shows a top view of the dual spray pattern of FIG. 4B showing the overlapping circular patterns for the left 412 and right 414 spray patterns.

FIG. 4E depicts a spray density plot 416 through the center of the pattern of FIG. 4C showing the high spray density at the circular pattern and low density in the "hollow" center of the pattern. The "hollow" center is particularly characteristic of a constant flow through the nozzle, in contrast to the pulsating flow of the present invention. FIG. 4F depicts a spray density plot 418 through the center of the pattern of FIG. 4B. The pattern has a more even distribution than that of FIG. 4E. The two spray patterns tend to fill the center better with less peak concentration on the circle.

FIG. 4G depicts the spray distribution 420 for a varying pulse flow in accordance with the sine wave pulsed flow of the present invention. The pulsed flow tends to fill the center better than the constant flow of FIG. 4E. A filled circular pattern preferably has a density minimum between the peaks of no less than 50% of the peak value, more preferably no less than 75% of the peak. FIG. 4H depicts the pulsed flow effect 422 on the distribution of the dual swirl nozzle of FIGS. 4B and 3B.

FIG. 4I-FIG. 4L depict a three piston embodiment. The nozzle is configured like FIG. 4B, but modified to have three pistons with three feed channels at 120 degree intervals around the swirl chamber. Each piston produces a respective spray pattern 424, 426, 528, 430, 432, 434. The composite spray pattern is more evenly distributed than FIG. 4C 436, 438 and is more circular than that of FIG. 4D. See FIG. 4J.

Applications

In one application of the invention, the sprayer may be configured to deliver oils in a food preparation operation, in particular, non-stick oils. For delivery of such oils a larger droplet size than typically used for cleaner application or spray painting may be desirable. A larger droplet size may allow better control of the direction of the spray and may minimize mists that may drift in the air and coat undesired surfaces as well as reduce the air purity for the food workers. The use of a swirl chamber nozzle to produce larger droplet sizes allows the use of lower pressures, permitting a smaller motor and battery. Thus the configuration of the present invention may enable a small hand held battery operated sprayer suitable for use in a kitchen or other food-processing environment. The unit may be small and light enough to replace a typical aerosol can or hand pump sprayer. A powered pump sprayer based on high pressure spray techniques would likely utilize much more power and require a larger motor and battery or a plug-in design.

In a further advantage of the invention, the pump may be driven by a fixed field voltage driven electric motor, i.e., not series wound, for example, a permanent magnet or shunt wound motor. Thus, the RPM is held constant rather than the torque, resulting in a constant flow rate (cubic centimeters per minute) rater than constant pressure to the nozzle. This maintains performance over temperature in spite of variations in viscosity of the fluid.

For an exemplary application of spraying vegetable oil, the oil may have a kinematic viscosity of about 15 to 250 centiStokes, typically 40 centiStokes at 25 C room temperature. Water is about 1 centiStoke.

Sprayer Tests

Two exemplary sprayers were tested for comparison of spray pattern and battery life. The sprayers were designed in accordance with a vegetable oil spray application of the present invention. One sprayer was fitted with a 22 oz (624 ml) bottle and the other one was fitted with a 36 oz (1020 ml) bottle. In addition, an aerosol can and two trigger sprayers were tested for comparison.

The spray patterns were observed at a distance of 8 inches (20 cm). The spray pattern results were as follows:

| Sprayer | Pattern Size | Pattern Shape | Flow rate |
|---|---|---|---|
| 36.0 oz. sprayer | 4.5 inch (12 cm) | oval | 1.4 grams/second |
| 22.0 oz. sprayer | 5.75 in (15 cm) | Round with two ears | 3.1 grams/second |
| cooking oil aerosol can | 3.6 inch (9 cm) | circle | 1.0 grams/second |
| trigger sprayer | 7.25 in (18 cm) | fan | 1.3 grams/stroke |
| 2-hole trigger sprayer | 8.75 in (22 cm) | fan | 1.2 grams/stroke |

The sprayers were tested for adequacy of battery performance for use in a commercial kitchen setting. The nickel metal hydride (NiMH) sprayer batteries were fully charged to 10.8 V. The sprayers were each alternately sprayed for 8 seconds to mimic the time to spray a sheet pan. The process was continued for one hour. Both sprayers performed fully for the one hour test. The 22 oz sprayer battery discharged to 9.5 V and the 36 oz sprayer battery discharged to 9.3 v, indicating substantial charge remaining in both sprayers. Thus, it appears that both sprayers would likely operate on a single battery charge for a full typical 8 hour work shift in a kitchen setting. An alternate variation may utilize lithium ion batteries or other battery types.

Another exemplary sprayer operates at 12000 RPM on a voltage of 11.1V at 0.5 A using an 800 mAH battery. Thus, the sprayer can run for 1.6 hours at 100% duty cycle and 8 hours at 20% duty cycle, which may be typical for some kitchen operations.

Embodiments

Figure 5:
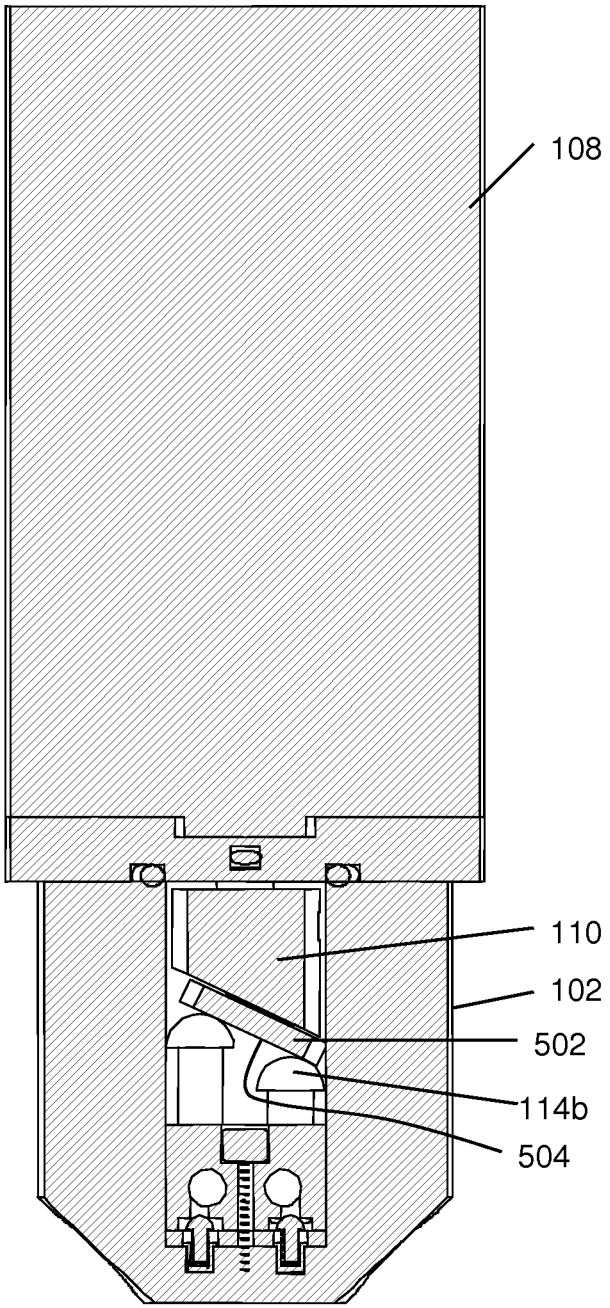
FIG. 5 illustrates a side cross section view of an exemplary sprayer having an intermediate plate between the wobble plate and the pistons.

FIG. 5 illustrates a side cross section view of an exemplary sprayer having an intermediate plate (alternatively referred to as a spinner plate) between the wobble plate and the pistons. The intermediate plate 502 is rotationally mounted on the wobble plate 110 at a diagonal angle and allowed to rotate freely relative to the wobble plate. The intermediate plate has a planar surface 504 perpendicular to the axis of rotation of the intermediate plate. The planar surface 504 is for contacting the pistons and driving the pistons. Friction with the top of the pistons 114*b*, will reduce rotation relative to the pistons and minimize wear on the top of the pistons 114*b*.

Figure 6:
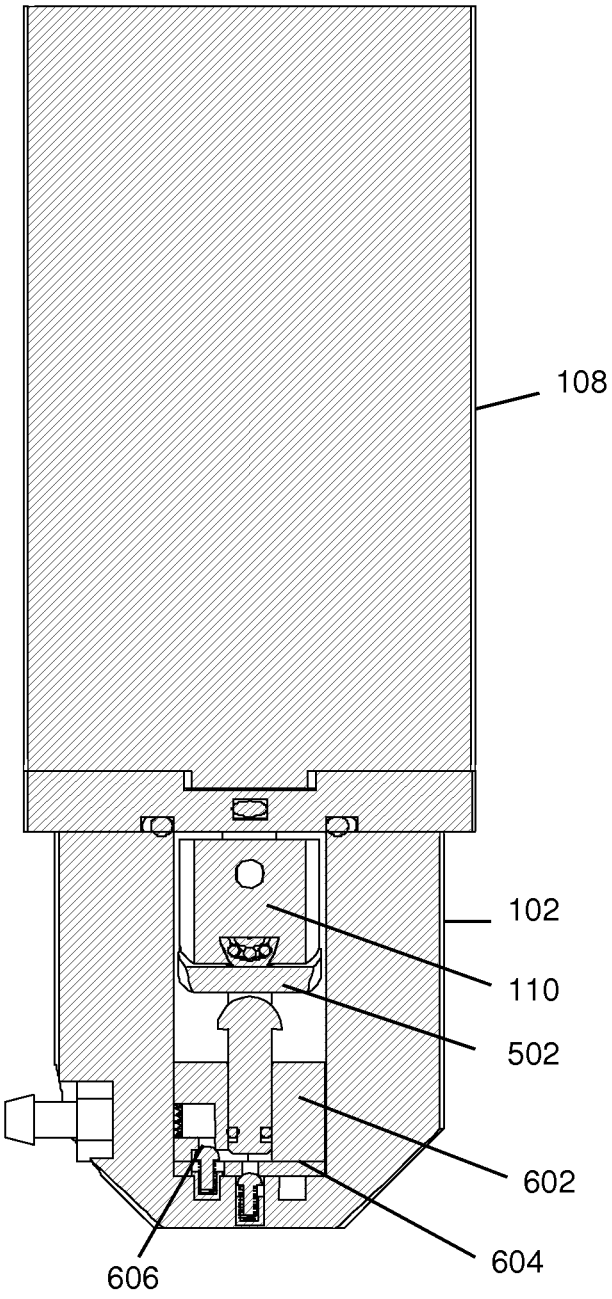
FIG. 6 illustrates a 90 degree rotated side view of the sprayer of FIG. 5.

FIG. 6 illustrates a 90 degree rotated side view of the sprayer of FIG. 5. A portion of a bearing mount for the intermediate plate 502 is shown. The sprayer of FIG. 6 shows a two piece 602, 604 construction for the cylinder insert. The top section 602 includes the piston cylinder side wall and a fluid inlet port. The inlet valve seat is formed in the top insert. The bottom insert 604 forms the cylinder head surface. The arrangement allows the inlet port to be at the bottom of the cylinder through the side wall of the cylinder.

Figure 7:
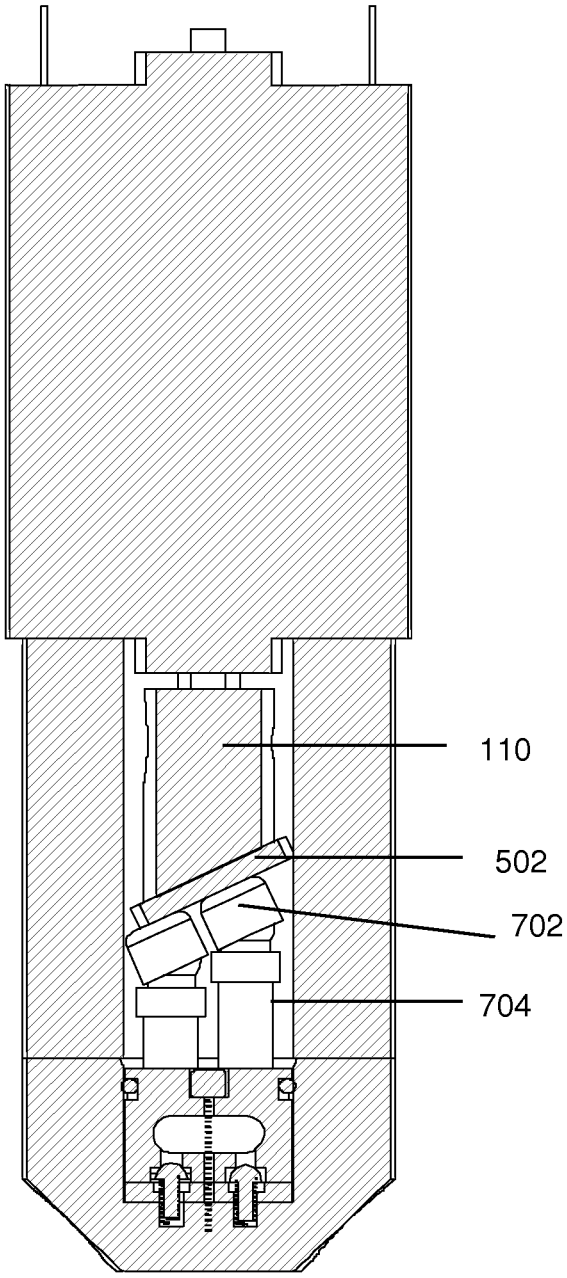
FIG. 7 illustrates a side cross sectional view of an exemplary sprayer wherein the pistons have a top cap for contact interface with the intermediate plate.

FIG. 7 illustrates a side cross sectional view of an exemplary sprayer wherein the pistons have a top cap 702 for contact interface with the intermediate plate 502. The piston top cap 702 has a flat surface for contact with the intermediate plate 502 to minimize contact pressure and resulting wear. The underside of the piston cap 702 has a spherical contact with the piston 704. The top cap 702 can thus rotate freely relative to the piston 704.

Figure 8:
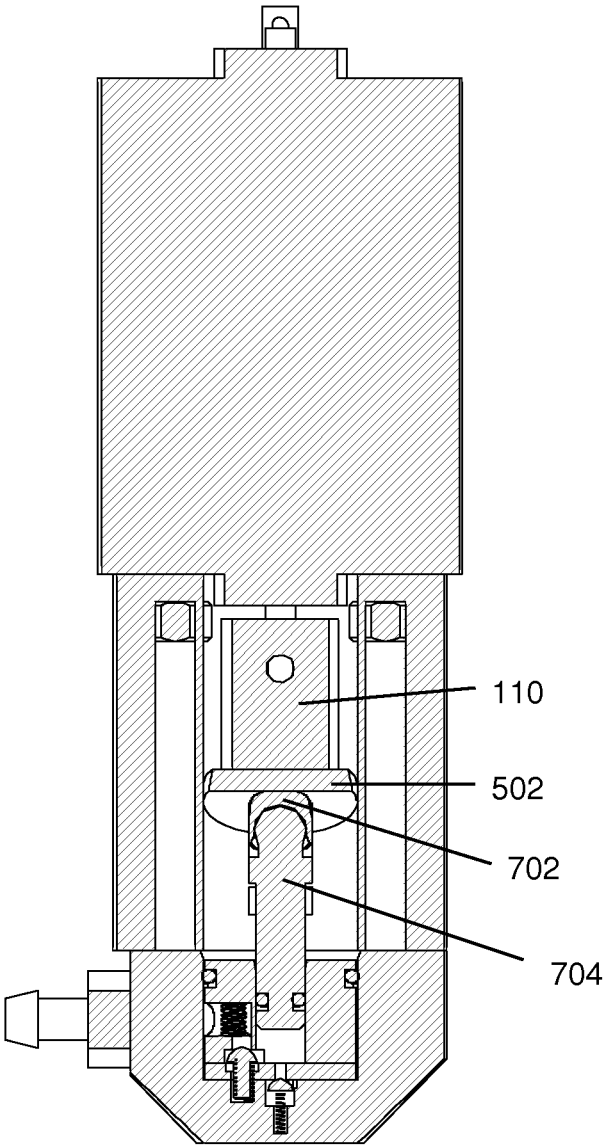
FIG. 8 illustrates a 90 degree rotated side cross sectional view of the sprayer of FIG. 7.

FIG. 8 illustrates a 90 degree rotated side cross sectional view of the sprayer of FIG. 7. The piston cap 702 can be seen to have a flat contact with the intermediate plate and a spherical contact with the piston. The two piece piston insert allows for fluid inlet at the bottom side wall of the cylinder.

Figure 9:
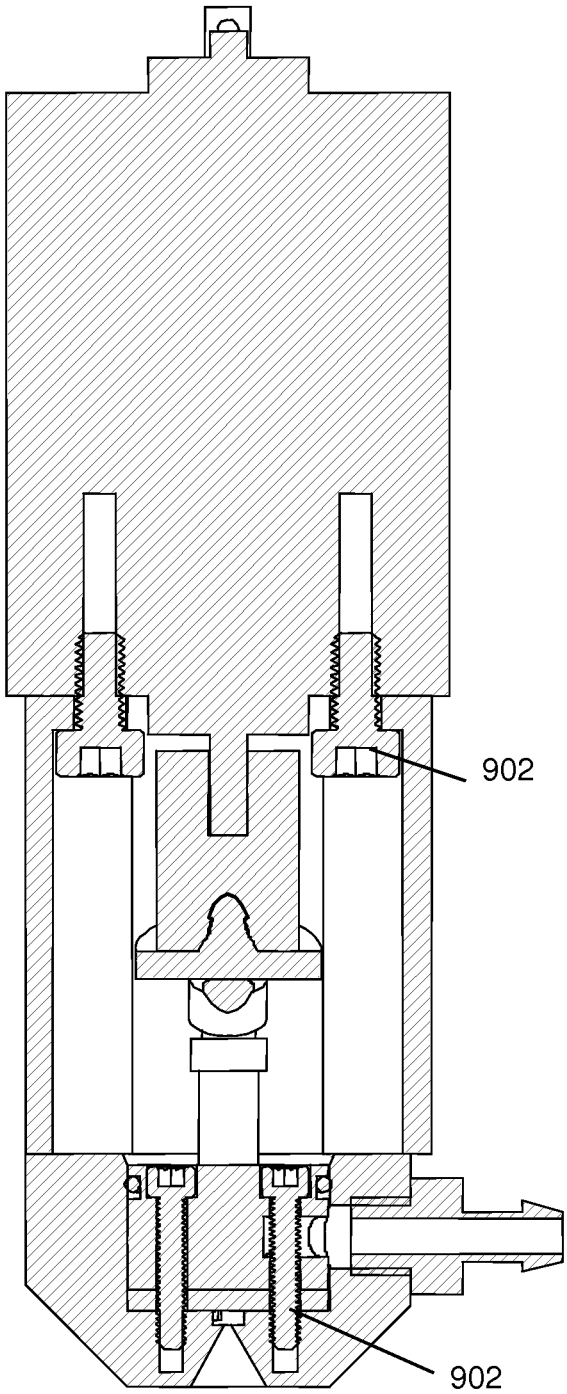
FIG. 9 illustrates a side cross sectional view of the sprayer of FIG. 7 showing assembly screws.

FIG. 9 illustrates a side cross sectional view of the sprayer of FIG. 7 showing assembly screws 902.

Figure 10:
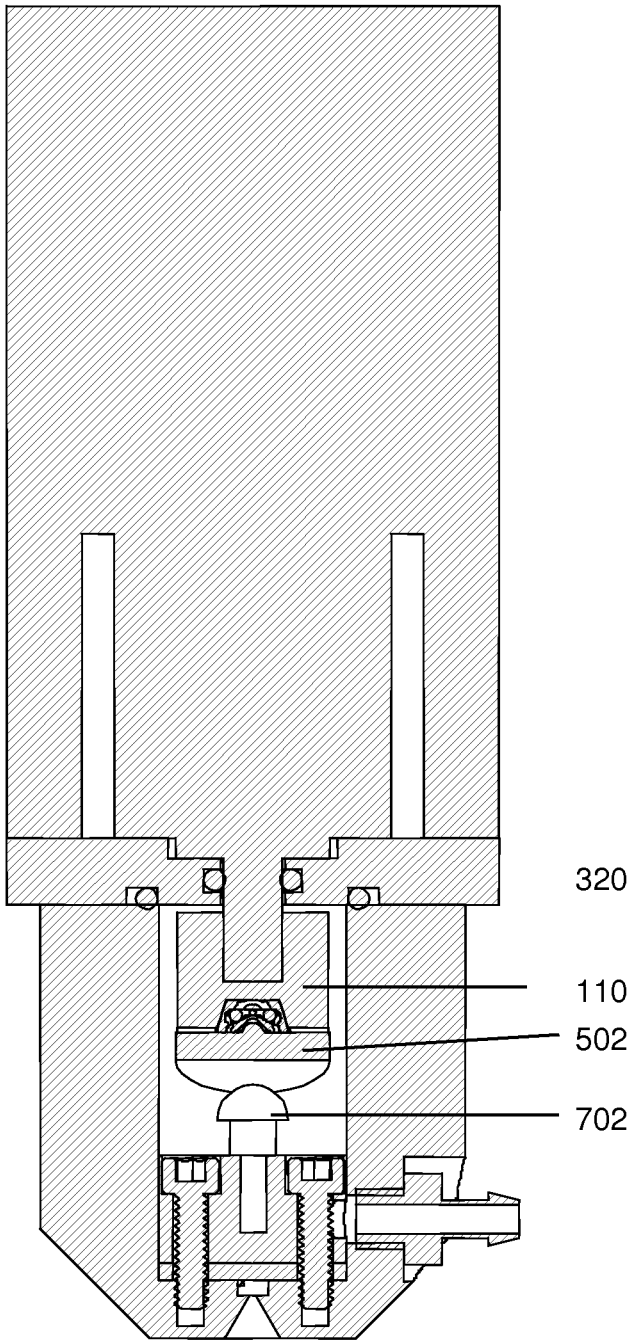
FIG. 10 illustrates an alternative embodiment of FIG. 9.

FIG. 10 illustrates an alternative embodiment of FIG. 9.

Figure 11:
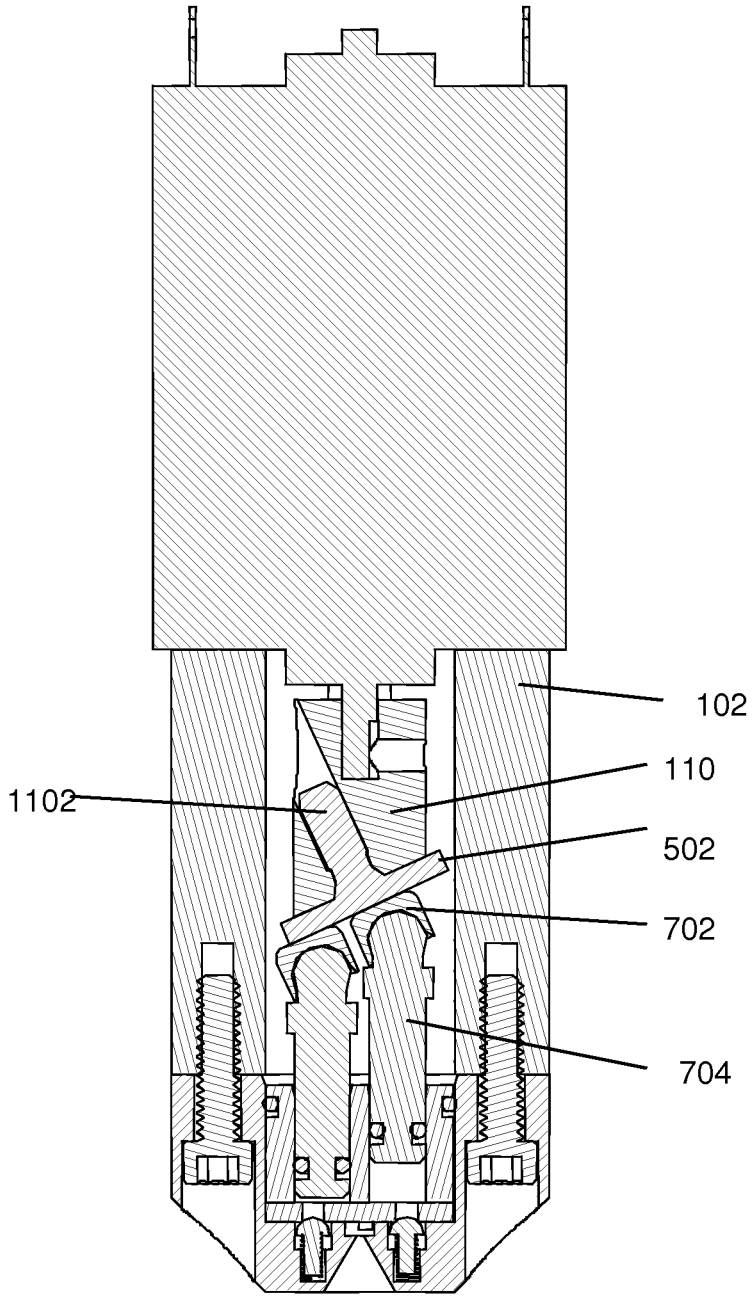
FIG. 11 illustrates a side cross sectional view of the sprayer of FIG. 7 showing the rotational mounting of the intermediate plate.

FIG. 11 illustrates a side cross sectional view of the sprayer of FIG. 7 showing the rotational mounting of the intermediate plate 502. The intermediate plate 502 has a shaft 1102 disposed in a bore in the wobble plate 110 for free rotation of the intermediate plate 502 relative to the wobble plate 110. The shaft 1102 is fixed to the intermediate plate 502 and perpendicular to the face of the intermediate plate 502.

Figure 12:
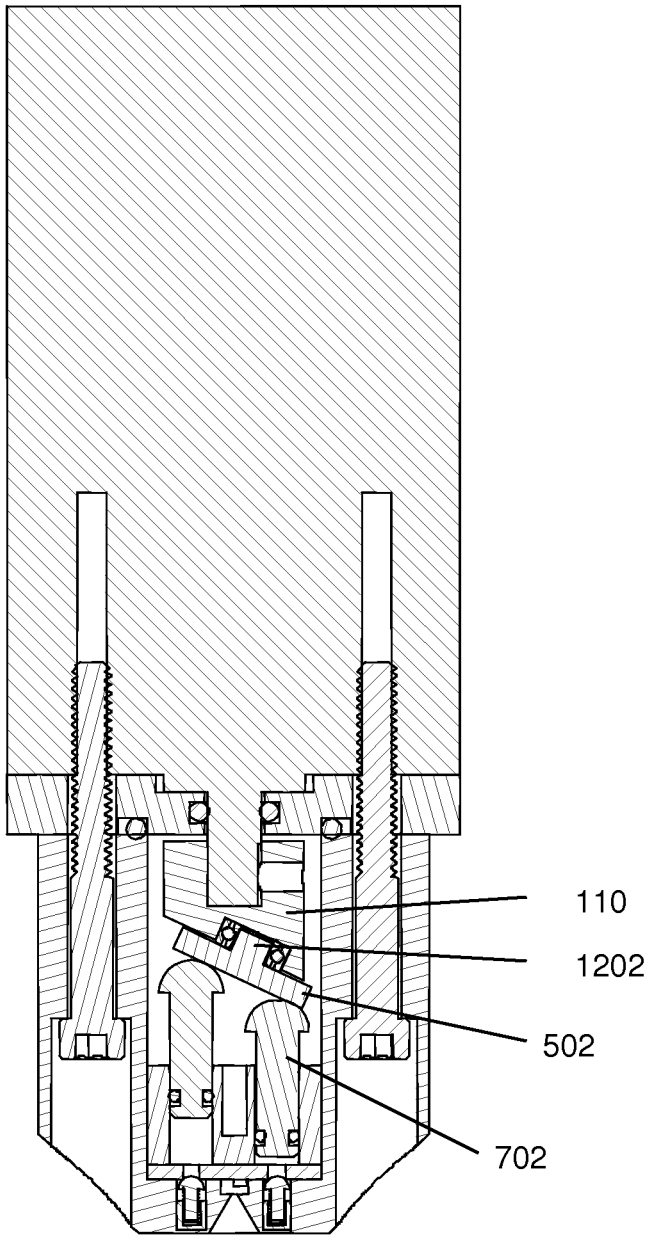
FIG. 12 illustrates a side cross sectional view of the sprayer of FIG. 7 showing an alternative ball bearing mounting of the intermediate plate to the wobble plate.

FIG. 12 illustrates a side cross sectional view of the sprayer of FIG. 7 showing an alternative ball bearing mounting 1202 of the intermediate plate 502 to the wobble plate 110.

Figure 13:
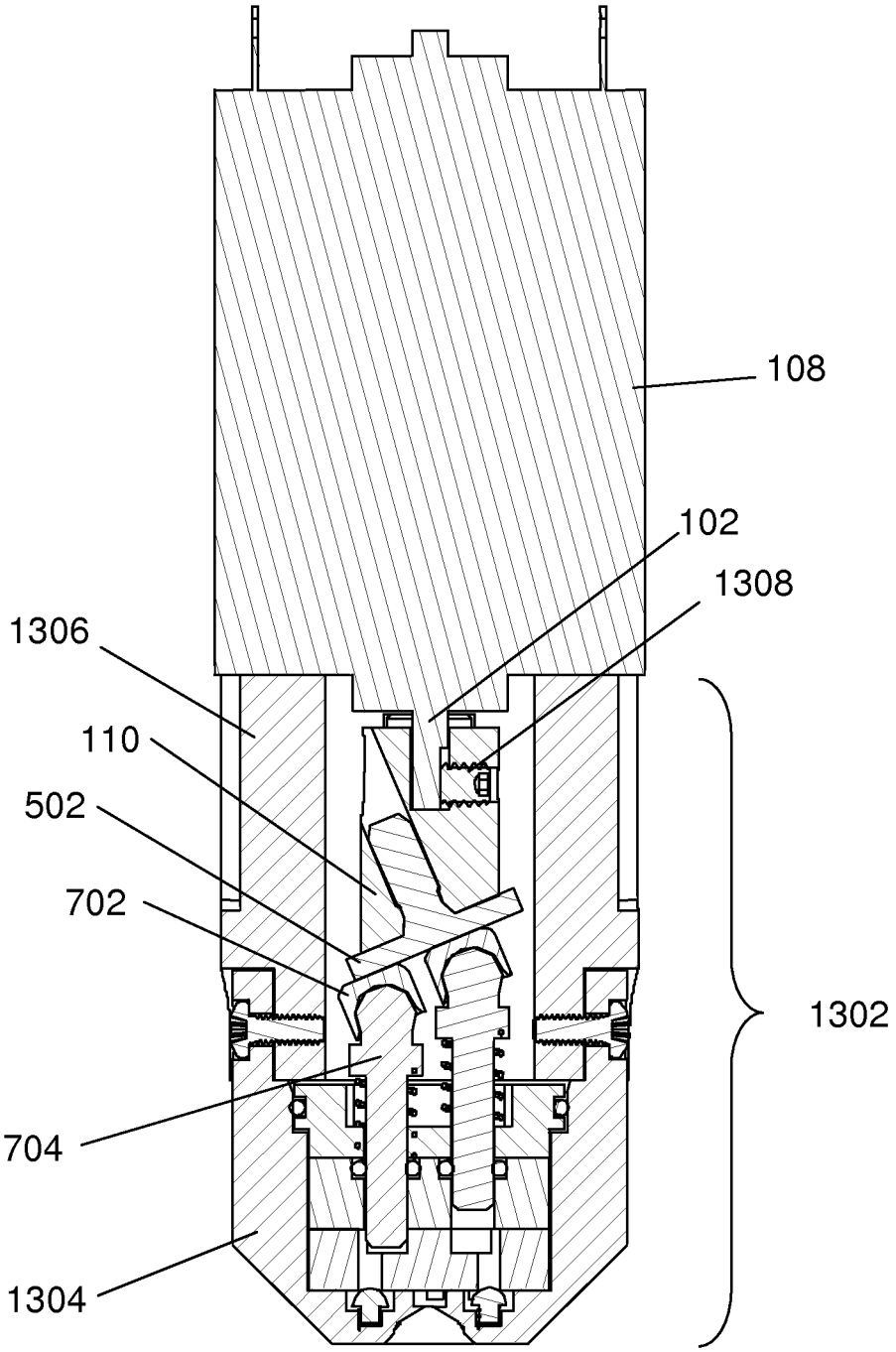
FIG. 13 illustrates a side cross sectional view of an exemplary sprayer in accordance with the present invention.

FIG. 13 illustrates a side cross sectional view of an exemplary sprayer in accordance with the present invention. FIG. 13 shows a sprayer comprising a motor 108 and integrated pump and nozzle section 1302. The integrated pump and nozzle section is shown in greater detail in FIG. 14.

In one variation, the sprayer of FIG. 13 may comprise a highly efficient sprayer for spraying heavy oil generally, more particularly, for example, for applying non-stick cooking oil to a cooking surface. The oil may have a kinematic viscosity of typically 40 centistokes and may range from 15 to 250 centistokes. Typical prior art sprayers for paint produce a fine mist and utilize very high pressures, requiring considerable power. The present sprayer avoids the fine mist and efficiently delivers dropletized spray in a filled circular pattern. The high efficiency of the sprayer enables a unique hand held battery operated unit that can operate for a full work shift in an active kitchen on a single battery charge. Less efficient sprayers may likely require a plug-in or reduced operating time on a charge.

In one variation, the sprayer may be characterized as:

| | |
|---|---|
| Motor | 14000 rpm, 12 Volts, 0.55 Amps |
| Battery | 12 V, 800 mAH |
| Pumping rate | 1.2 ml/second |
| Fluid kinematic viscosity | 40 centiStokes |
| 8 hour total pumping capacity | 7 liters |
| Duty cycle of use during 8 hour shift | 20% |
| Overall length (without motor) | 3 cm |
| Overall width (without motor) | 3 cm |
| Total weight without motor | 20 grams |
| Motor added length | 3 cm |
| Motor added weight | 30 grams |

Figure 14:
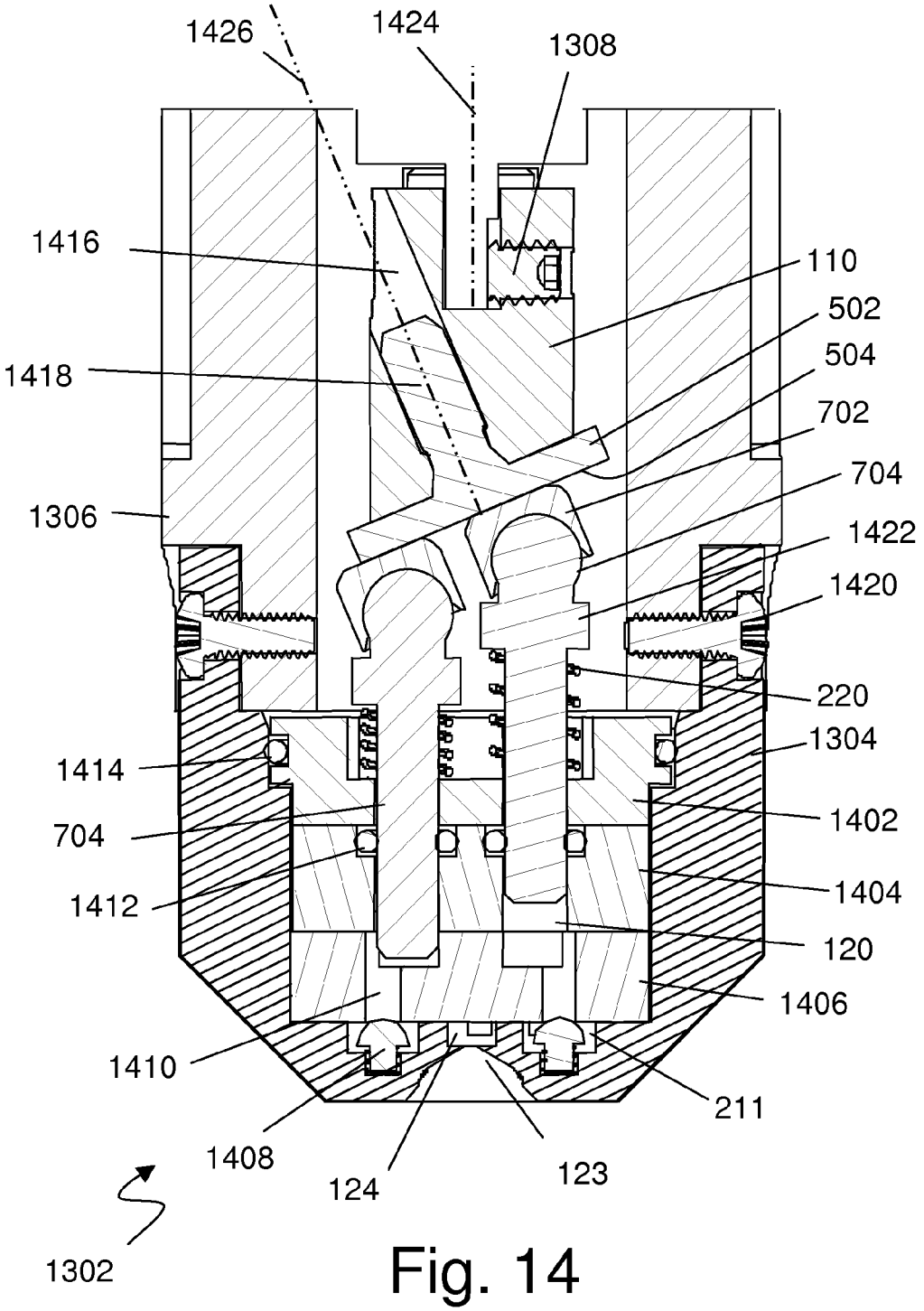
FIG. 14 shows the integrated pump and nozzle section of the sprayer of FIG. 13.

FIG. 14 shows the integrated pump and nozzle section of the sprayer of FIG. 13. Referring to FIG. 13 and FIG. 14, the wobble plate 110 is coupled to the motor shaft 102. The wobble plate member 110 comprises a wobble hub for attaching to the motor and a wobble plate having a diagonal face or diagonal axis bearing for holding and driving the spinner plate. The wobble hub assembly may be fabricated from a single piece of material. The wobble hub assembly is a multifunctional part for coupling to the motor and for holding and driving the diagonal spinner plate and allowing the spinner plate to free rotate. The assembly may be modified in accordance with FIG. 12 to mount the spinner plate using a ball bearing or separate bearing. It may be appreciated that when using a separate bearing, the diagonal planar face shown for the wobble hub component 110 may not be needed, only the bearing axis features need be provided.

The motor shaft drives the wobble plate to rotate around a motor axis 1424. An exemplary setscrew 1308 is shown securing the wobble plate 110 to the motor shaft 102. The wobble plate 110 is a cylinder with a diagonal face opposite the motor end and a bore 1416 perpendicular to the diagonal face for receiving a shaft 1418 of an intermediate plate member 502 (alternatively referred to as a spinner plate 502). The bore axis may preferably intersect the motor axis, i.e., may be coplanar with the motor axis. The intermediate plate member 502 freely rotates around the axis 1426 of the bore, allowing low friction rotation of the intermediate plate. In the embodiment shown in FIG. 14, a proximal side (close to the motor) of the intermediate plate 502 is in contact with the diagonal face of the wobble plate 110. A distal side is in contact with the piston assemblies and drives the piston assemblies.

The motor drive axis 1424 and the spinner plate rotation axis 1426 should intersect at the plane of the distal surface of the spinner plate 502 in contact with the piston caps 502. The invention, however, tolerates deviations in any direction, vertical, horizontal or out of plane (as shown in the drawing) due to the free rotation of the spinner plate. The spinner plate 502 and wobble hub 110 together should be rotationally mass balanced with respect to the drive axis 1424 to minimize vibration.

The piston assemblies each comprise a piston 704 and a piston cap 706. Each piston 704 has a spherical head end proximal to the motor 108. The piston cap 702 has a matching spherical recess for receiving the piston spherical head. The piston cap 702 has a substantially flat side proximal to the motor for contacting the intermediate plate 502. The sides of the piston cap 702 are sufficiently deep to maintain the cap disposed on the top of the piston 704 during operation. As shown, the sides of the cap 702 encompass more than 180 degrees of the piston spherical head and "snap" into place during assembly. The piston cap 702 may freely rotate axially and laterally on the piston head, allowing low friction rotation.

Each piston has a shoulder 1422 for spring loading by preload springs 220. Each piston is spring loaded against a cylinder assembly (1402, 1404, and 1406), thus maintaining spring loaded contact through a stack comprising the pistons 704 through the piston caps 702 and intermediate plate 502 to the wobble plate 110. Multiple factors may be considered when setting the spring preload. The spring preload should be minimized to minimize friction in the wobble plate drive members; however the preload should be sufficient to prevent unloading the stack at the maximum rotation rate, i.e., the spring force should be greater than the mass of the cap and piston multiplied by the maximum axial acceleration of the cap and piston.

$$f > (m_p + m_c)\omega_m r \tan(\theta)$$

where, f is the minimum required force for the spring;

$m_p$ is the mass of the piston;

$m_c$ is the mass of the cap;

$\omega_m$ is the maximum rotation rate of the motor drive;

r is the contact radius of the piston cap on the intermediate plate; and

θ is the angle of the intermediate plate.

Alternatively, or in addition, the spring rate may be set such that the spring—mass resonance of the spring acting with the mass of the piston with cap is between two harmonics of the rotation rate, for example 1.5, 2.5, or 3.5 times the rotation rate. Thus, for 2.5 times the rotation rate:

$$F = \frac{1}{2\pi}\sqrt{\frac{k}{m_p + m_c}}$$

$$F = 2.5\left(\frac{\omega_m}{2\pi}\right)$$

$$k = \frac{(2.5\omega_m)^2}{m_p + m_c}$$

where,

F is the resonant frequency of the spring—mass system;

k is the spring constant;

$m_p$ is the mass of the piston;

$m_c$ is the mass of the cap; and $\omega_m$ is the maximum rotation rate of the motor drive, (radians).

One may also consider pump priming and may set the piston preload to overcome a vacuum in the cylinders. Thus the force may be:

$$f = kx > P_a \frac{\pi d^2}{4}$$

where, f is the spring force required;

k is the spring constant;

x is the maximum displacement;

$P_a$ is the atmospheric pressure (14.7 psi); and d is the diameter of the piston.

Lateral forces on the pistons resulting from drive from the intermediate plate are resisted by the side walls of the cylinders. The pistons are sealed with an o-ring 1412 recessed into the cylinder block assembly. The o-ring channel is formed by the first and second cylinder block sections at the interface between the first and second cylinder block sections. Dividing the cylinder block at the interface between section 1 and section 2 as shown allows easy assembly of the o-ring and allows easy machine fabrication of injection mold tooling for the o-ring. The o-ring is preferably configured in a slot in the cylinder block rather than the piston to prevent weakening the piston by an o-ring slot in the piston.

The cylinder block assembly comprises three sections configured for injection molding utilizing two part simple molds. The top section 1402 (proximal to the motor) includes a recess for the piston spring seating surface. An o-ring 1414 is provided to prevent leakage of pumping fluid into the wobble plate chamber. The middle section 1404 includes the piston o-ring 1412 to prevent leakage through the piston bore back into the wobble plate chamber. The third section 1406 includes the cylinder head section of the cylinder including inlet and outlet ports in the cylinder head. The third section also includes the outlet valve seats formed directly in an outlet channel 1410 leading from the outlet ports in the cylinder head recess. The three sections 1402, 1414, 1406 form an assembly fastened together by two bolts (FIG. 15 ref 1504) through the top and middle sections, threaded into the nozzle section 1304. The cylinder block assembly fits into a nozzle section 1304 and cooperates with the nozzle section to form the outlet valve chambers 211, swirl chamber 124, and nozzle feed channels 304 (FIG. 3B).

The nozzle section 1304 cooperates with the distal section 1406 of the cylinder head assembly to form the output valve structures 211 and the swirl chamber 124. The nozzle section has recessed wells configured to hold the valve plunger 1408 and spring. The wells include a wide top section and a narrow bottom section. The bottom section locates the valve spring and valve plunger. The wider top section allows for flow through the well and out through a transfer slot 304 to the swirl chamber 124. The wells, transfer slots, and swirl chamber may be formed by injection molding requiring a simple two part mold. The mold tooling may be fabricated with simple machining operations, since there are no complex shapes, only straight line holes and slots. The open side of each is closed by the cylinder head distal section, which provides for flow into the valve chamber from the cylinder outlet port. The cylinder head assembly provides a simple flat face covering the top of the transfer slot and swirl chamber, also requiring no complex mold tooling structure. The outlet port 1410 lines up with the valve plunger 1408 forming a valve seat at the interface. The tapered valve plunger 1408 provides self alignment with the outlet port valve seat.

Figure 15:
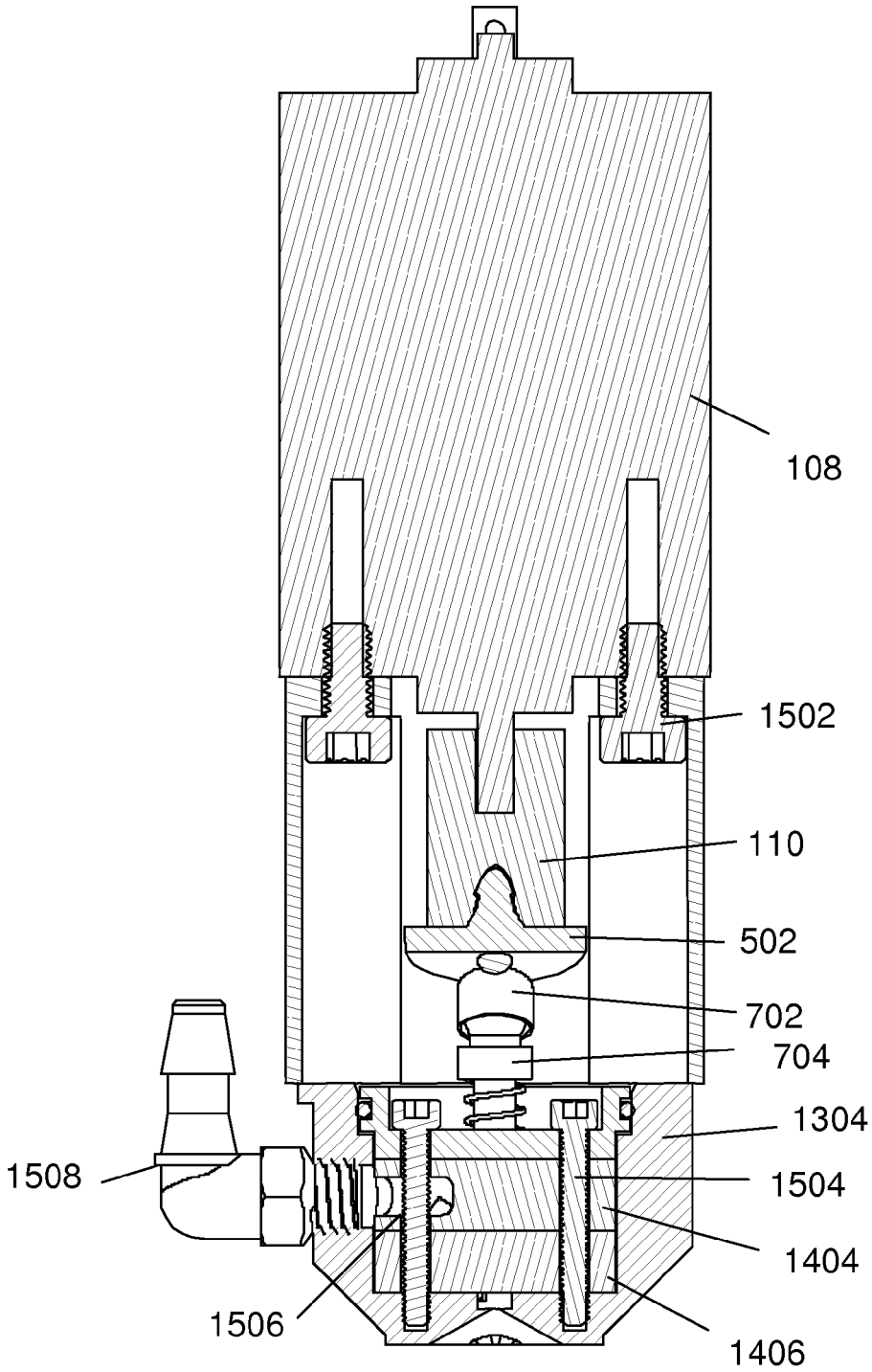
FIG. 15 and FIG. 16 illustrate cross sections of the exemplary pump of FIG. 13 from planes perpendicular to the plane of FIG. 13.
Figure 16:
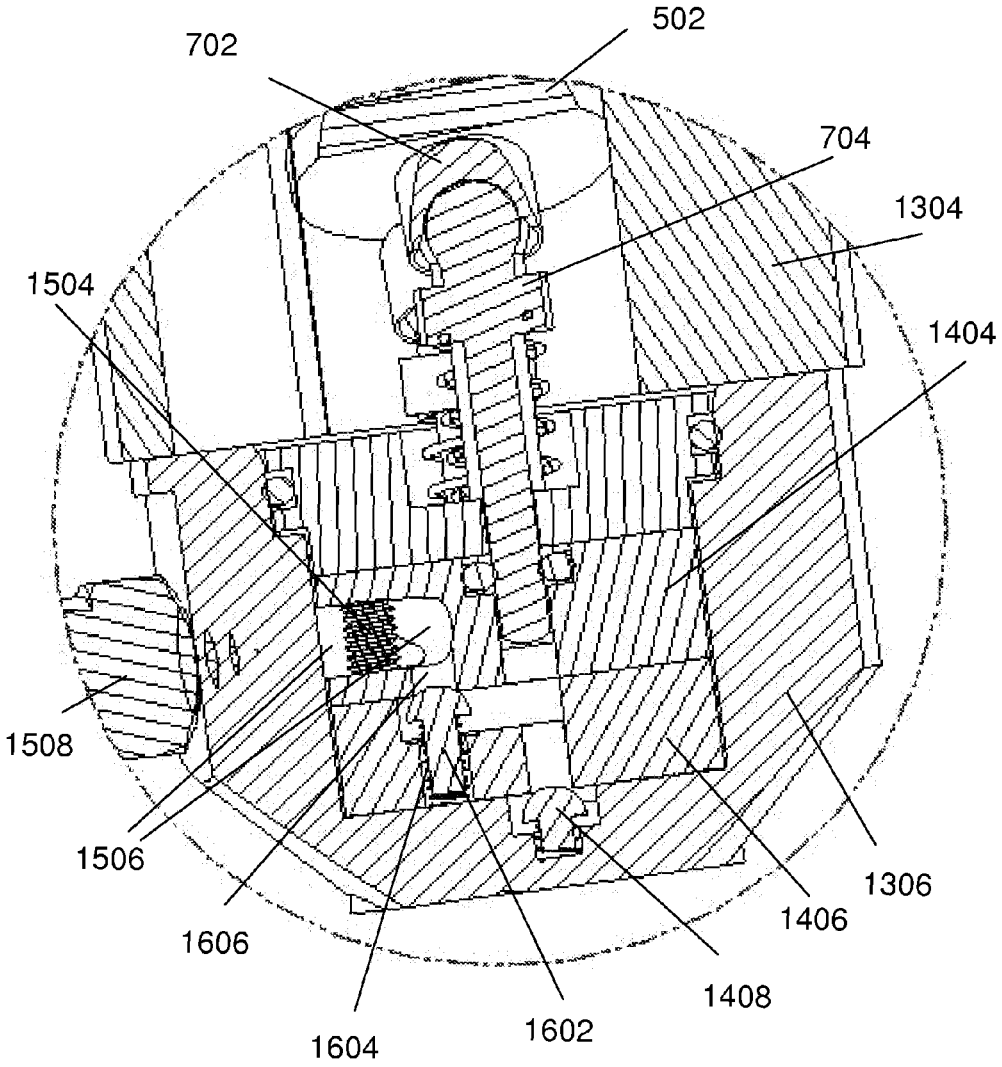

FIG. 15 and FIG. 16 illustrate cross sections of the exemplary pump of FIG. 13 from planes perpendicular to the plane of FIG. 13.

Referring to FIG. 15, FIG. 15 is a cross section through the center of the pump. FIG. 15 shows the inlet port and manifold and the mounting screws.

FIG. 16 is a cross section parallel to the plane of FIG. 15, but offset from center, passing through the inlet and outlet valves of one of the pistons. Referring to FIG. 16, FIG. 16 shows the arrangement of elements in relation to the cylinder block illustrating the utilization of simple moldable components. The inlet fitting is threaded into the nozzle block, which is face to face coupled to the center section of the cylinder block assembly. The center section includes a manifold chamber leading to the two cylinder inlet valves and inlet ports. The manifold is ported to the side of the center section and opens through a round passage to the bottom of the center section. The passage terminates in a valve seat for the inlet valve. The valve seat opens into an inlet passage leading to the inlet port. The inlet passage is formed as a trough in the distal section covered by the flat side of the center section. The center section and distal section are separated at a planar face. The inlet valve is disposed within a valve recess in the in the inlet passage of the distal section. The valve recess may extend through the distal section. A spring loaded valve is disposed within the valve recess and extending through the inlet passage to the valve seat of the center section. The inlet passage leads to the inlet port at the bottom of the cylinder. The outlet valve is coupled to the bottom of the distal section. The outlet port is at the bottom of the cylinder and leads to the outlet passage, which couples through the distal section to the bottom of the distal section. The end of the outlet passage forms a valve seat for the outlet valve. The outlet valve is disposed within an outlet valve recess or well in the nozzle section. The outlet valve and nozzle are described in greater detail with reference to FIG. 13 above.

Figure 17:
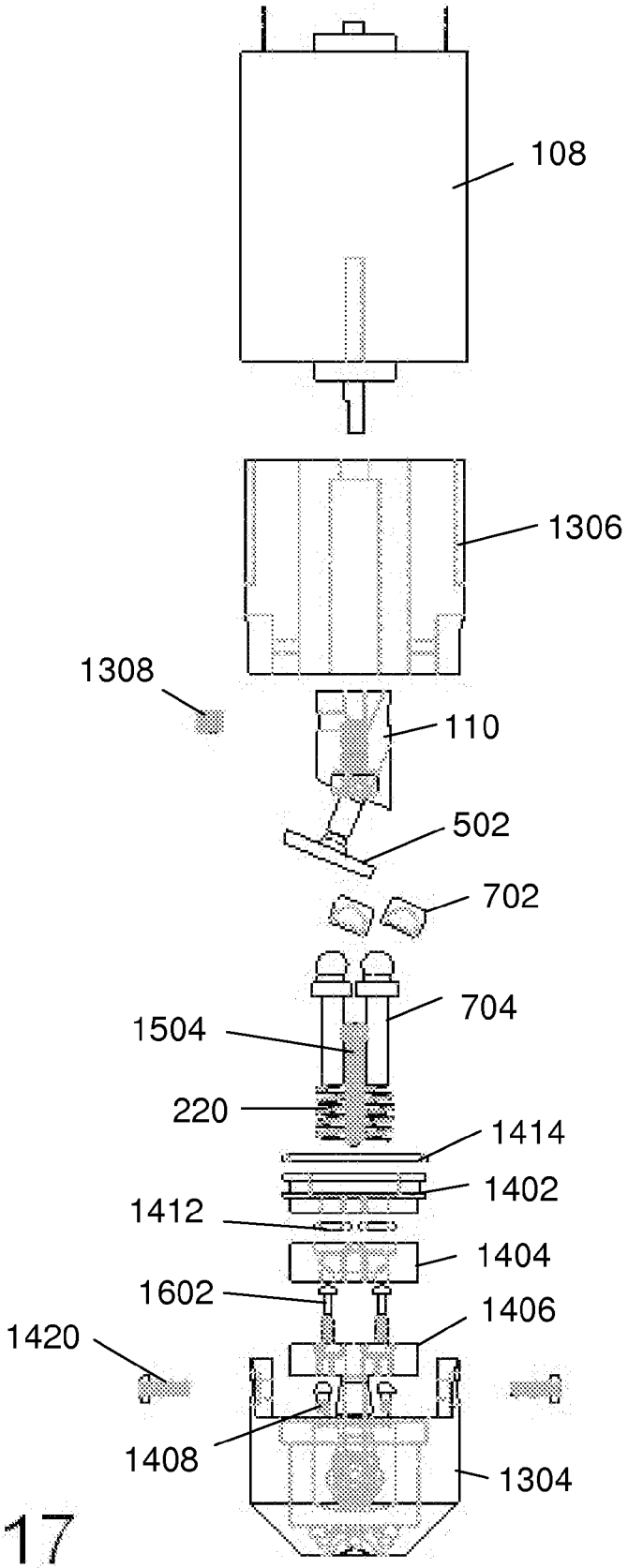
FIG. 17 is an exploded view of the sprayer of FIG. 13-FIG. 16.

FIG. 17 is an exploded view of the sprayer of FIG. 13-FIG. 16. FIG. 17 shows with greater clarity the individual components of the sprayer of FIG. 13 and FIG. 14.

Compression Ratio

The configuration of FIG. 13 allows for variation and tolerances in the dimensions of the various components and allows for wear in the pistons, caps and intermediate plate components. The spring return of the pistons will always keep the stack of components in contact and producing a full piston stroke for a full volume pump per cycle. As the stack wears, the pistons may move slightly up allowing the minimum cylinder volume to increase and thus decreasing the compression ratio. However, for incompressible fluids, such as oil, the compression ratio is substantially immaterial. Thus, the pump performance is constant for a wide range of wear. It remains desirable, however, to maintain a good compression ratio for self priming of the pump at startup. A good compression ratio will allow a suction vacuum to be developed to draw fluid from a container when pumping air or other compressible fluids out of the lines. A compression ratio of two to one or better should allow priming from nearby or attached containers.

High Speed Pulsation

In one application of the sprayer, the sprayer is used to spray non-stick vegetable oil. The vegetable oil is preferably sprayed in small droplets, but not so small that they become airborne and drift beyond the application surface. To assist in breaking up the stream into a spray and generating a desired circular filled pattern, the sprayer may be operated at a high rotation rate, for example 7000 revolutions per minute. This results in 14000 pulses per minute (233 pulses per second) from the two piston sprayer. The high rotation rate and resulting high pulse rate itself may be responsible in part for the breakup of the stream into droplets. This may be due to additional radial stress on the spray cone due to rapid modulation of the spray velocity and cone size by the varying flow rate. Thus a modestly performing nozzle may be improved by feeding the nozzle with a pulsed flow at a high pulse rate.

The pulsed flow simultaneously modulates the flow from the swirl chamber in two ways. First, the higher flow creates more centrifugal force to overcome surface tension and distribute the spray in a wider cone. Second, the higher flow produces a higher forward velocity in the instantaneous spray cone. Thus, the combined effect is to generate a modulated spray with a radial velocity shear across the flow pattern that tends to break up the initial flow into droplets. Thus, the modulated flow simultaneously fills the interior of the conical pattern defined by the fastest flow and breaks up the flow into droplets. For example, an average flow of 1 ml/sec through a 0.25 square mm nozzle is initially 400 cm/sec velocity through the nozzle. Peak velocity would be double, or 800 cm/sec. The 80 cm/sec flow might produce a 10 cm wide instantaneous conical pattern at 40 cm distance. The 40 cm/sec flow might produce a 6 cm wide instantaneous conical pattern. At 200 pulses per second, the 800 cm/sec flow travels 4 cm in one pulse cycle; whereas the 400 cm/sec flow travels 2 cm—a difference of 2 cm. During this time, the difference in radial travel is 0.2 cm—one tenth as much. Thus, the modulation induced shear greatly exceeds the spreading effect of the cone by itself. The two effects would appear to be equal at a pulse rate of one tenth as much or 20 pulses per second, which would result from 600 rpm motor speed. The effect would be more pronounced at five times that speed or 3000 rpm.

In the case where the flow rate is high and the spray cone angle changes little with the velocity modulation, the spray velocity difference causes turbulence in the spray cone as the high velocity fluid overtakes the slow fluid and as the high velocity separates from the slow velocity. High and low velocity flows may interact in the same pulse or between subsequent pulses. This turbulence contributes to the breakup of the flow into droplets. Thus, the pulse rate should be high enough so that the fast flow catches up with the slow flow and mixes before reaching the spray target. In the above example, the fast flow would just catch the slow flow in 40 cm at ten pulses per second (300 RPM with two cylinders). To give time to mix and develop the pattern, the rate should preferably be somewhat higher, for example at least five times higher 3000 pulses per minute (1500 RPM) or at least ten times higher 6000 pulses per minute (3000 RPM) which agrees with observations.

In one variation adapted for applying cooking oil, the motor rotation rate may be above 2000 revolutions per minute, preferably from 3000 to 30,000 revolutions per minute, more preferably from 4000 to 20,000 revolutions per minute.

At a very high pulse rate, the pistons should be closely coupled through rigid lines and passages to the swirl chamber. Long lines or flexible lines may allow smoothing of the pulse flow and reduction of the benefits.

A second reason for a high pulse rate relates to producing a substantially continuous spray for depositing a uniform layer when sweeping across a target surface.

When applying oil or other high viscosity fluids to a surface, the operator typically directs the sprayer at the surface from a distance, for example, 20 cm to 40 cm, and scans (or sweeps) the spray pattern across the surface to coat the surface. Thus, the spray pattern should be essentially continuous and constant during the application. Pulses that are too slow would produce a discontinuous coating. The pulse rate should be sufficient to produce a uniform pattern while being scanned across a target surface. Thus, the pulsations should occur several times across the scanning of the width of the spray pattern. For example, if the sprayer sprays a two inch (5 cm) wide pattern and the operator scans the target at 10 inches (25 cm) per second, a pulse rate of five pulses per second would just fill the centerline of the scan. A preferred pulse rate would be twice that or ten pulses per second. More preferable would be ten times or fifty pulses per second. Thus, the 233 pulses per second of the exemplary embodiment would be suitable for even higher scanning rates.

In the sprayer of FIG. 13 and FIG. 14, the wobble plate/intermediate plate drive produces an approximate offset sine function flow rate. Alternatively the function may be described as a sine squared function. The practical geometry and real world implementation may cause some deviation from an ideal sine function. Each piston operates 180 degrees out of phase with respect to the other piston. Thus the resulting flow rate follows an offset sine function with two pulses for each turn of the motor. Thus, the flow rate varies over the sine function cycle of each piston from zero to a maximum value and then back to zero. Each piston performs an input cycle when the other piston is performing an output pulse cycle.

Alternatively, a cam system may be used to alter the pump pulse shape. The wobble plate would be replaced with a drive cam. In one variation, the pump delivers at least two different non-zero flow rates.

Nozzle Dimensions

The sprayer of FIG. 13 may be used with various nozzle dimensions. Table 1, nozzle 4 is preferable for delivering 50 ml/min, nozzle 5 is preferable for delivering 75 ml/min, and nozzle 6 is preferable for delivering 100 ml/min vegetable oil.

Alternating Plastics

In one variation, the pump parts may be made of plastic. One desirable combination uses nylon sliding against acetyl as a low friction pair. Thus, the wobble plate may be nylon, the intermediate plate may be acetyl, the piston caps may be nylon, and the pistons may be acetyl. The cylinder assembly may be nylon to continue the alternating pattern or may be acetyl for greater strength. An alternate pattern would begin with acetyl and alternate with nylon. Other plastic combinations may be used. Low friction treatments or additives to the plastics may be used. In one variation, at least one friction interface comprises a low friction pair of materials, for example low friction plastics, for example nylon and acetyl.

Asymmetrical Drive

In one embodiment, the pump may comprise a swirl chamber and may pulse the swirl chamber with differing alternating pulses. The differing pulses may produce two different instantaneous spray patterns resulting in a desired composite spray pattern. For example the swirl chamber may be pulsed with a strong pulse alternating with a weaker pulse (less pressure and/or less flow rate). The stronger pulse may produce a wider spray pattern. The weaker pulse may produce a more narrow spray pattern. The more narrow spray pattern may serve to fill in the wider pattern, producing a more even, filled in pattern.

In one alternative, the differing pulses may be produced by differing piston diameters for the two pistons. In another alternative, the differing pulses may be produced by differing center offset for the two pistons relative to the wobble plate drive, or a cam drive with differing cams for the different pistons.

Alternatively, the swirl chamber may be fed by two feed channels having differing geometry—a first channel at the edge, a second channel slightly more centered. The edge channel may produce more swirl with a wider pattern and the more centered feed channel may produce a more narrow pattern.

Tolerance Stack Up

A further advantage of the configuration of the present invention is that the part tolerance requirements are mitigated. For example, assuming a typical tolerance of +/−0.003 in per part. Considering the preload on the spring of the outlet valve 1602, FIG. 16. If the valve were placed higher in the stack, multiple layers would contribute to the spring preload error. Given that the preload of the 0.125 in length spring is 0.002 in., a +/−0.009 in, worse case tolerance would be intolerable. However, the present configuration ensures that the only tolerance on the recess is the height of the piston insert. +/−0.003 in.

Alternatives

In one alternative the pump section may be used as a pump for other purposes by replacing the nozzle with an outlet fitting. In a further alternative, the nozzle may be distant from the pump section by replacing the nozzle with an outlet fitting and running a length of tubing to the nozzle. However, in this configuration, one may note that a long length of flexible tubing may act as an accumulator and smooth the pulsations of the pump. This may result in a hollow core circular spray pattern if a swirl chamber nozzle is used. In one variation, an accumulator may be placed between the output of the pump and the nozzle to smooth the variations in pressure and provide a more hollow cone circular spray pattern, when using a swirl chamber nozzle.

Power Trigger Sprayer

Figure 18:
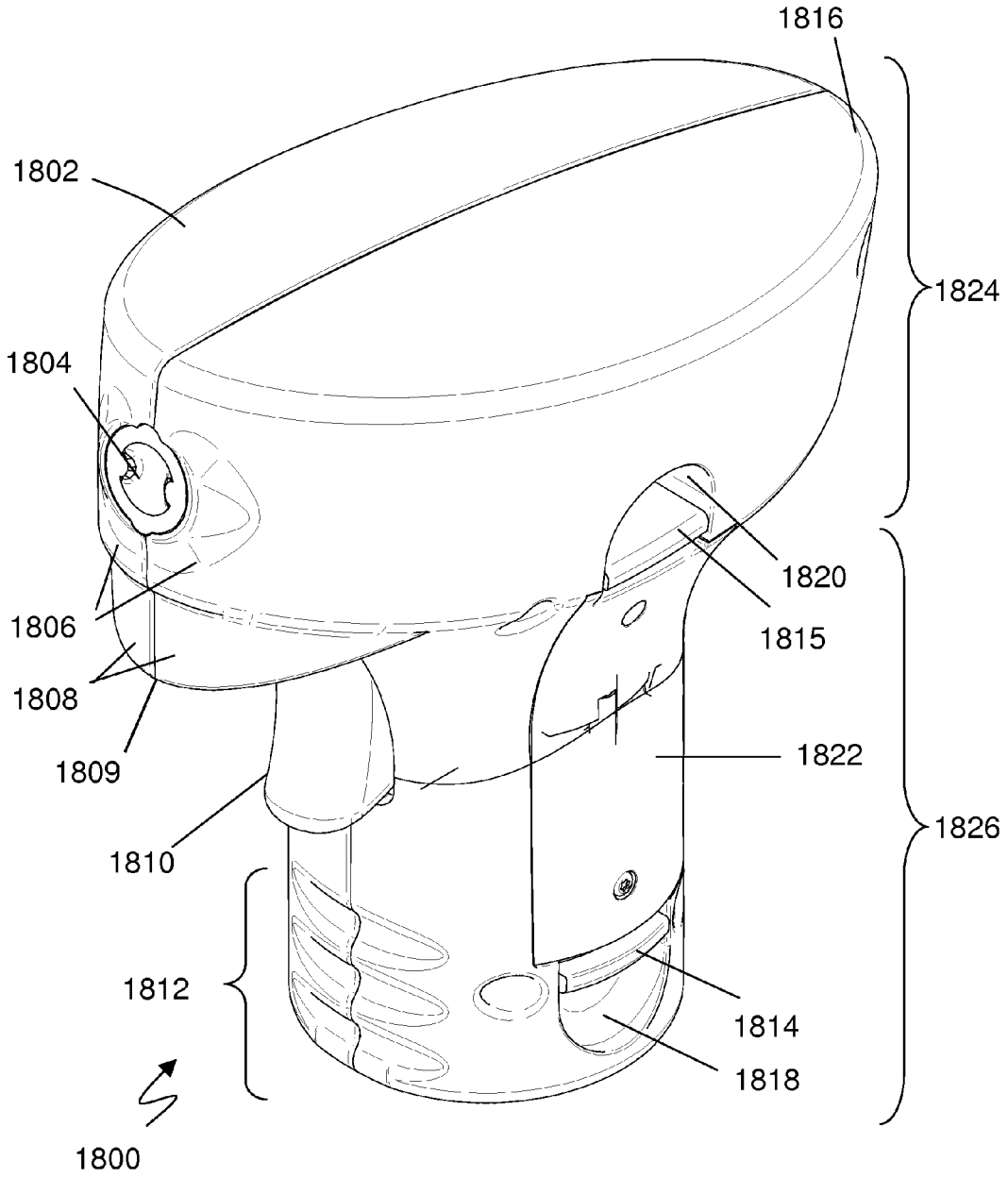
FIG. 18 illustrates a perspective view of an exemplary sprayer head assembly in accordance with the present invention.

FIG. 18 illustrates a perspective view of an exemplary sprayer head assembly in accordance with the present invention. Referring to FIG. 18, the sprayer head assembly 1800 comprises a left side shell 1802 and a right side shell 1816. FIG. 18 shows the nozzle 1804 of the integrated sprayer pump and nozzle. An expansion pattern 1806 surrounds the nozzle 1804 to transition from the nozzle to the shell. A drip shield 1808 may be part of the shell and extends downward from the nozzle 1804 and extends laterally on both sides of the nozzle 1804. A low point 1809 of the drip shield is directly below the nozzle 1804 and overhangs outside of an area to be occupied by a finger positioned for operating the sprayer. The drip shield should be disposed above at least part of the trigger and, horizontally, preferably at least 2 cm from the trigger 1810, more preferably at least 2.5 cm from the trigger. The drip shield should avoid the space directly in front of the center of the trigger, allowing quick access to grip the sprayer and activate the trigger.

A handle portion 1826 of the sprayer houses the trigger 1810 and battery holder 1822. A grip pattern 1812 is formed into the handle portion. The handle portion includes a lower recess 1818 for accessing the lower battery grip/latch 1814. An upper recess 1820 is provided in an upper portion 1824 for accessing an upper battery grip/latch 1815.

Figure 19:
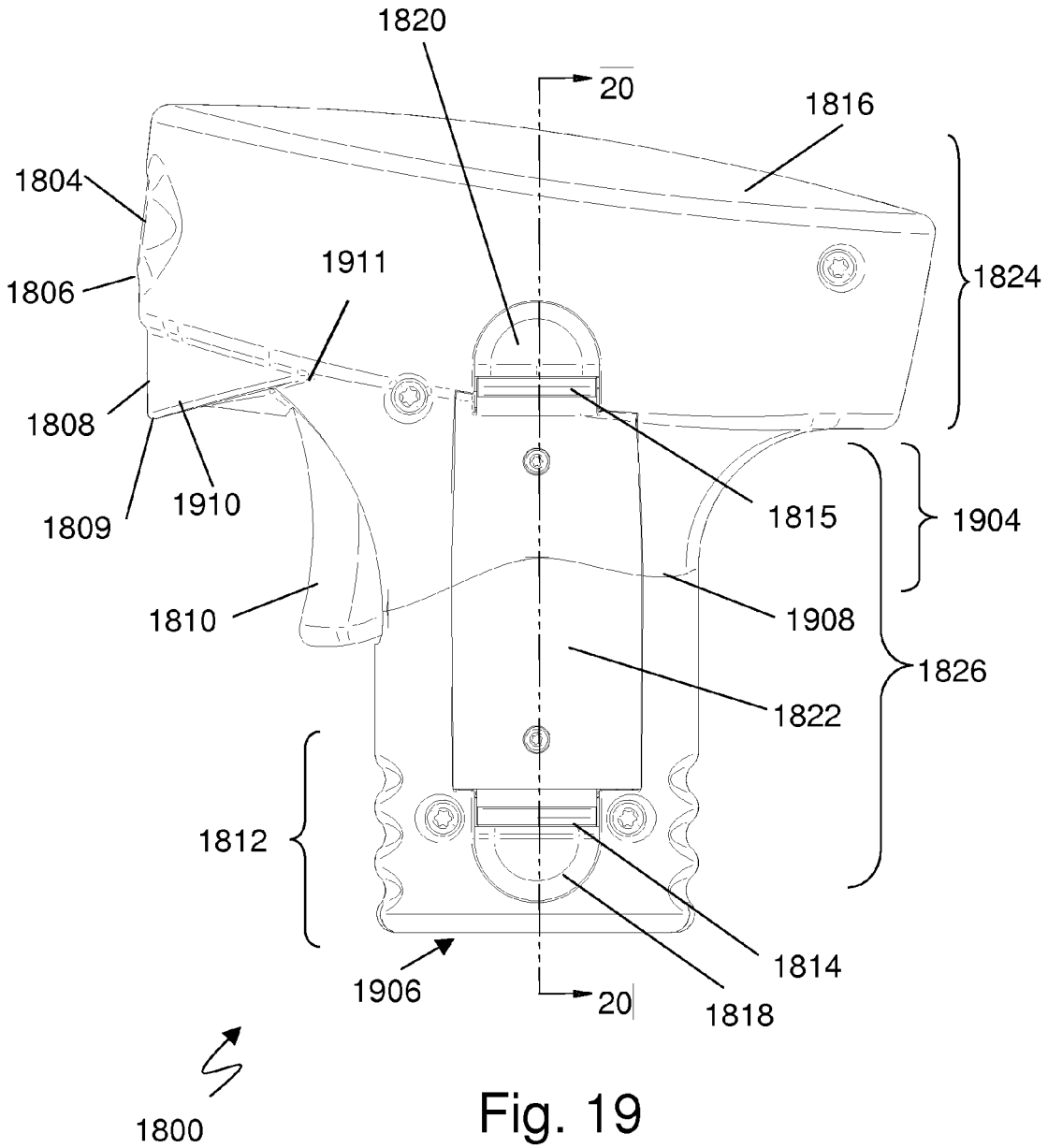
FIG. 19 is a left side elevational view of the exemplary sprayer head assembly of FIG. 18.

FIG. 19 is a left side elevational view of the exemplary sprayer head assembly of FIG. 18. The shell of FIG. 19 comprises an upper portion 1824, and a lower portion 1826. The lower portion 1826 comprises a transitional portion 1904. A transitional boundary 1908 at or above the bottom of the trigger and before mid trigger demarks a change in the contour of the shell. Below the boundary 1908, the vertical shell contour is essentially straight, except for features such as the grip 1812 or the battery holder 1822. Above the boundary, the vertical contour is curved from the grip portion to the spray head. See FIGS. 18-19. The straight portion simplifies tooling and production, reducing complex curves to a defined portion, the transitional portion.

In FIG. 19, the profile of the drip shield 1808 is shown. It can be observed that the lower edge 1910 has an upward slope from the lowest point 1809 at the front of the sprayer to a point 1911 of joining the upper portion 1824. The slope 1910 is at an upward angle of between five and forty five degrees, preferably between fifteen and thirty degrees, preferably about 20 degrees, measured when the bottom surface 1906 of the sprayer is level, as would typically be the case when the sprayer is mounted on a bottle and the bottle on a level surface.

Figure 20:
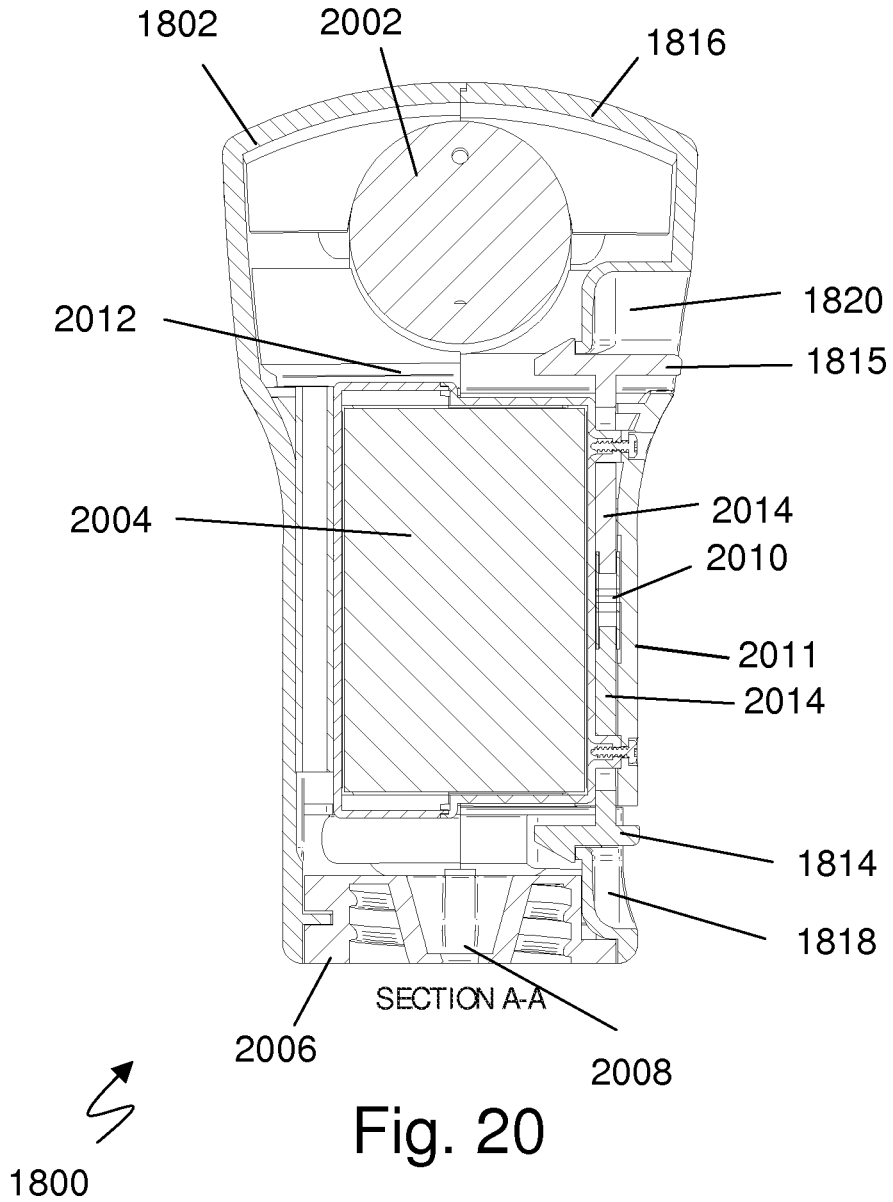
FIG. 20 is a front cross section view of the exemplary sprayer head assembly as indicated in FIG. 19.

FIG. 20 is a front cross section view of the exemplary sprayer head assembly as indicated in FIG. 19. FIG. 20 shows again the right 1802 and left 1816 shell structure. The integrated pump, motor, nozzle 2002 is shown mounted in the upper section 1902. The battery 2004 is shown laterally centered in the grip section. The battery holder mechanism may be seen in this view. The battery holder is held in place by two grip/latch tabs 1814, 1815 accessible from two recesses 1820, 1818 in the shell 1816. The grip/latch tabs are spring loaded 2010 and move vertically to release the catch from engagement with the shell when pressed by finger pressure. The grip/latch tabs slidably move in a channel in the battery module cover 2011 in response to the finger grip force. The tabs stop at a position allowing release of the battery, at which position, the same grip may remove the battery and place the battery in a charger (not shown) in one continuous motion. Another, charged, battery may then be placed in the sprayer. The grip/latch tabs are beveled to allow insertion and automatic latching without needing the tabs to be depressed to insert the battery.

FIG. 20 also shows the threaded bottle interface cap 2006. The cap includes threads for matching a desired fluid source bottle and a friction fit recess for receiving a fluid pickup tube. The fluid pickup tube may have a screen to limit the size of solid particles allowed in the flow and may have a weight to follow the lowest point in the bottle to pick up the last bit of fluid. Alternatively, the pickup tube may be fixed and located in a most typical location for the last bit of fluid. The fluid pickup tube is coupled from the interface cap to the pump inlet port (not shown).

Figure 21A:
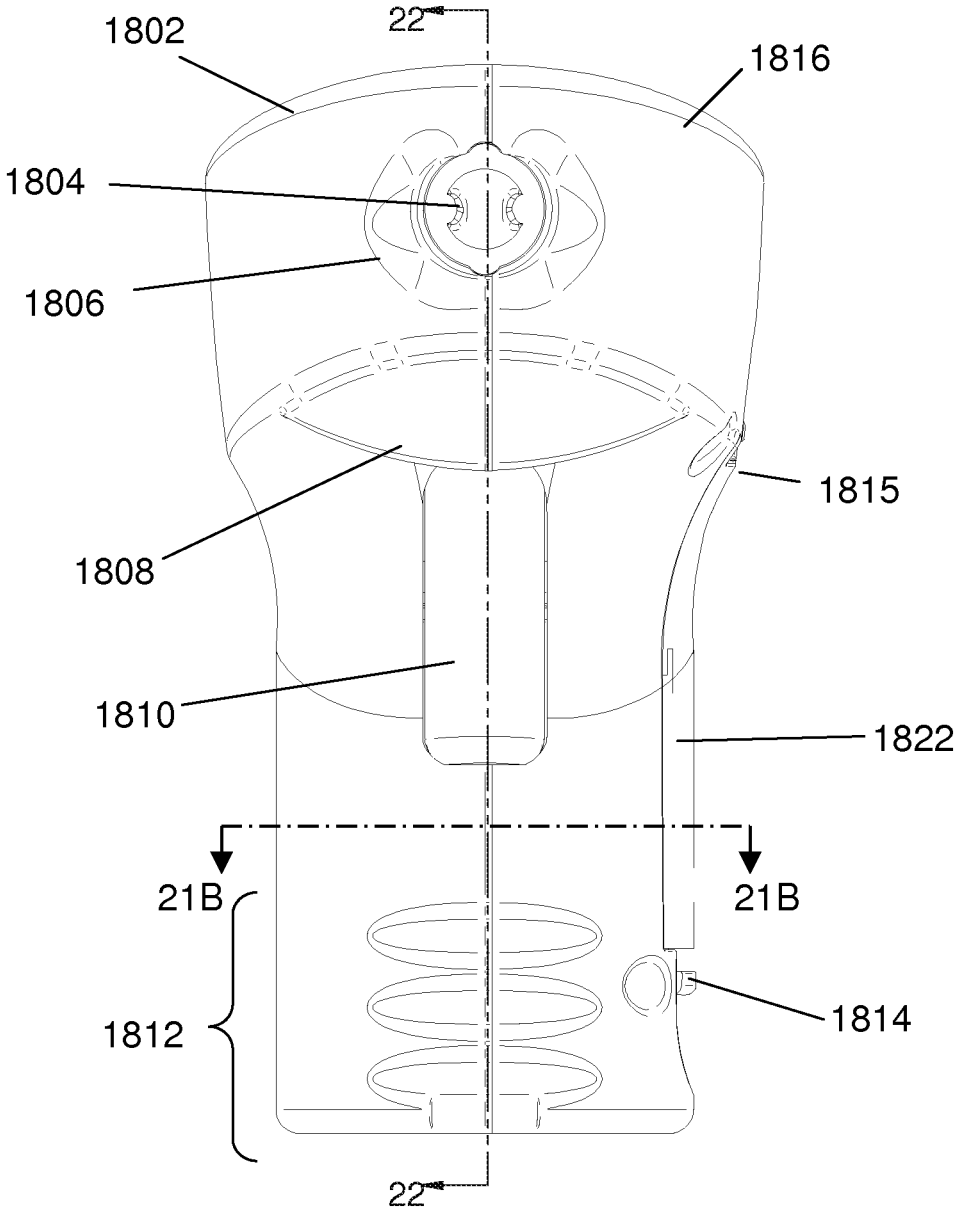
FIG. 21A is a front elevational view of the exemplary sprayer head assembly of FIG. 18.

FIG. 21A is a front elevational view of the exemplary sprayer head assembly of FIG. 18. FIG. 21 shows the nozzle transition structure 1806 that provides a transition from the nozzle to the shell. The transition structure provides support for the nozzle/pump assembly and should not interfere with the spray pattern. The transition structure may also be formed to have aesthetic appeal.

FIG. 21A also shows an exemplary grip pattern 1812. The grip pattern provides roughness or indentations to engage the grip of a hand. When the sprayer is used with oil or other fluids, a completely smooth plastic surface may be difficult to grasp. A grip pattern on part or all of the handle portion may be used to improve handling characteristics. Alternatively, or in addition, part or all of the handle may be coated or covered with a special grip enhancing material.

Figure 21B:
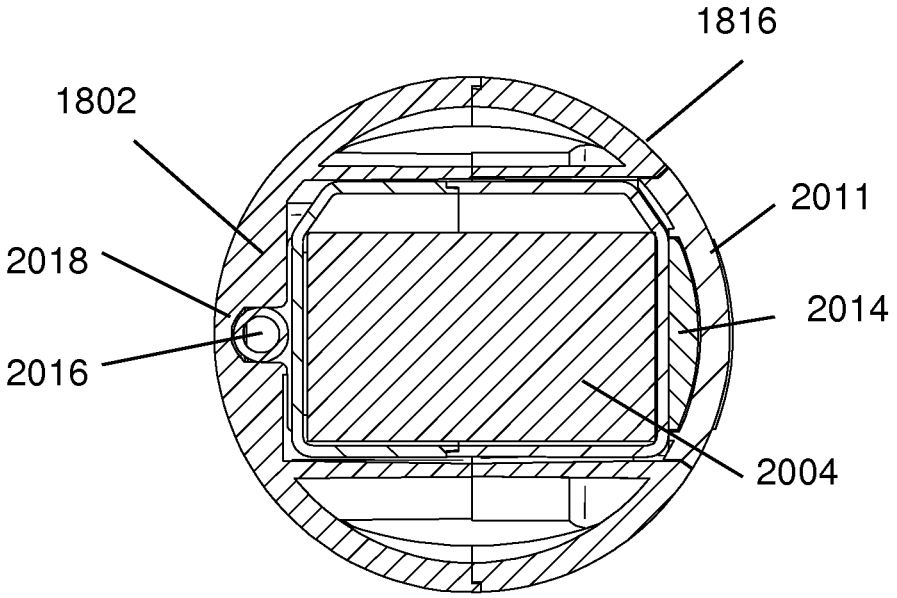
FIG. 21B is a cross section view as indicated in FIG. 21A.

FIG. 21B is a cross section view as indicated in FIG. 21A. FIG. 21B shows the cross section of the battery 2004 contained within the cross section of the shell 1802 and 1816. The cross section of the battery 2004 achieves a cross section area greater than 50% of the cross section area of the interior of the shell 1802 and 1816. The lithium battery has a rectangular form factor. The rectangular form factor is geometrically a good match for maximizing battery cross section and allowing straight lateral movement for installation and removal of the battery module.

Figure 22:
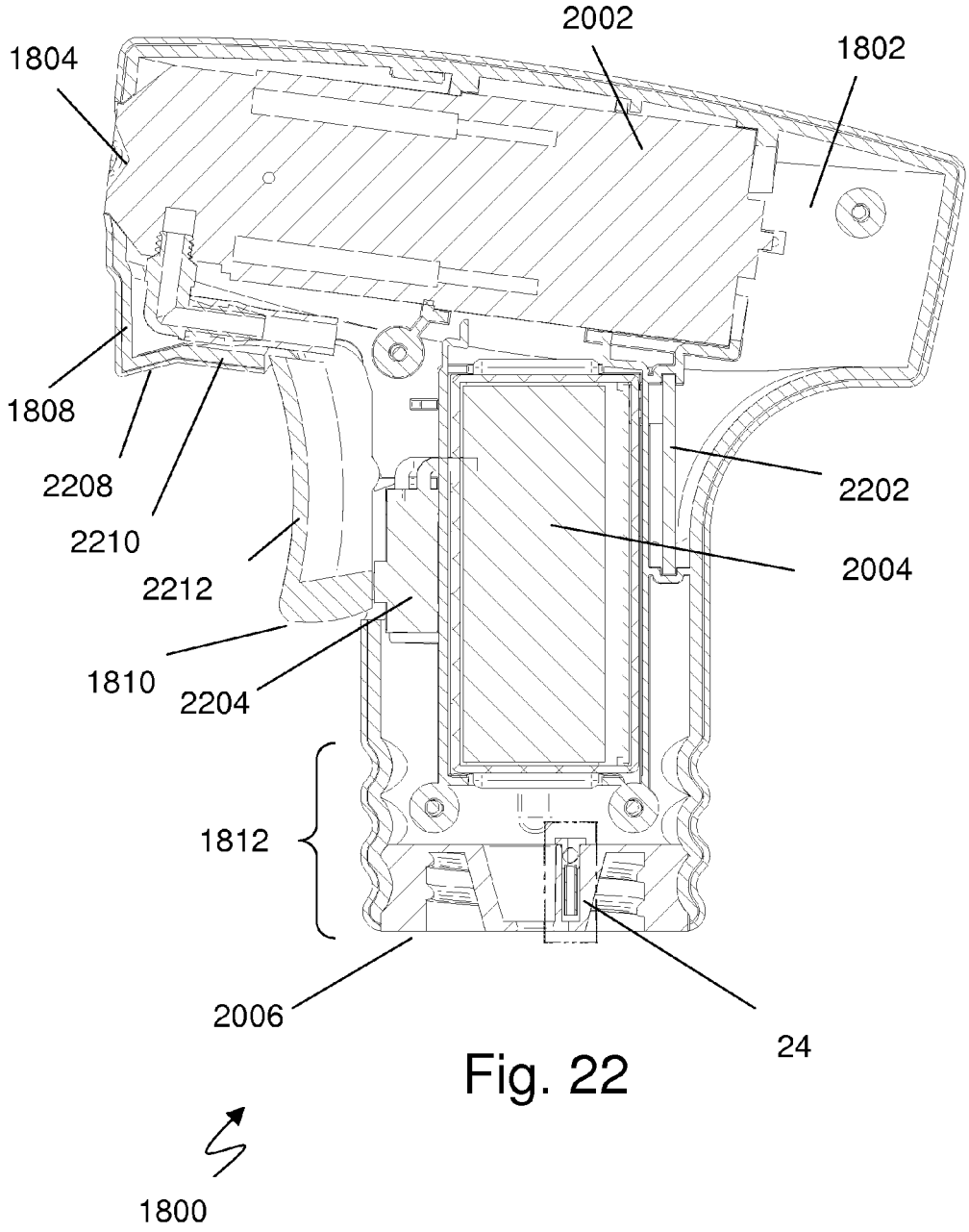
FIG. 22 is a left side cross section view of the exemplary sprayer head assembly as indicated in FIG. 21.

FIG. 22 is a left side cross section view of the exemplary sprayer head assembly as indicated in FIG. 21. FIG. 22 shows the pump, nozzle assembly, the battery 2004, switch 2204, battery connection board. FIG. 22 also shows the pump inlet tubing. The pump inlet tubing is run from the underside of the pump and angles toward the top of the battery compartment. The drip shield is modified with a downward sloping portion 2210 to allow the tubing to run above the drip shield on the way to the battery compartment. The drip shield has a first upward sloping portion 2208 from the lowest point to a higher point, then slopes downward 2210 parallel to the inlet tubing. The first upward sloping portion 2208 is sufficient to prevent drips from running backward toward the trigger.

FIG. 22 also shows the switch 2204 and battery connector board 2202. The switch is a single pole switch that switches battery power to the motor when depressed. (wiring not shown). The battery connector is positioned opposite the spray side of the sprayer to minimize the likelihood of contamination.

Figure 23:
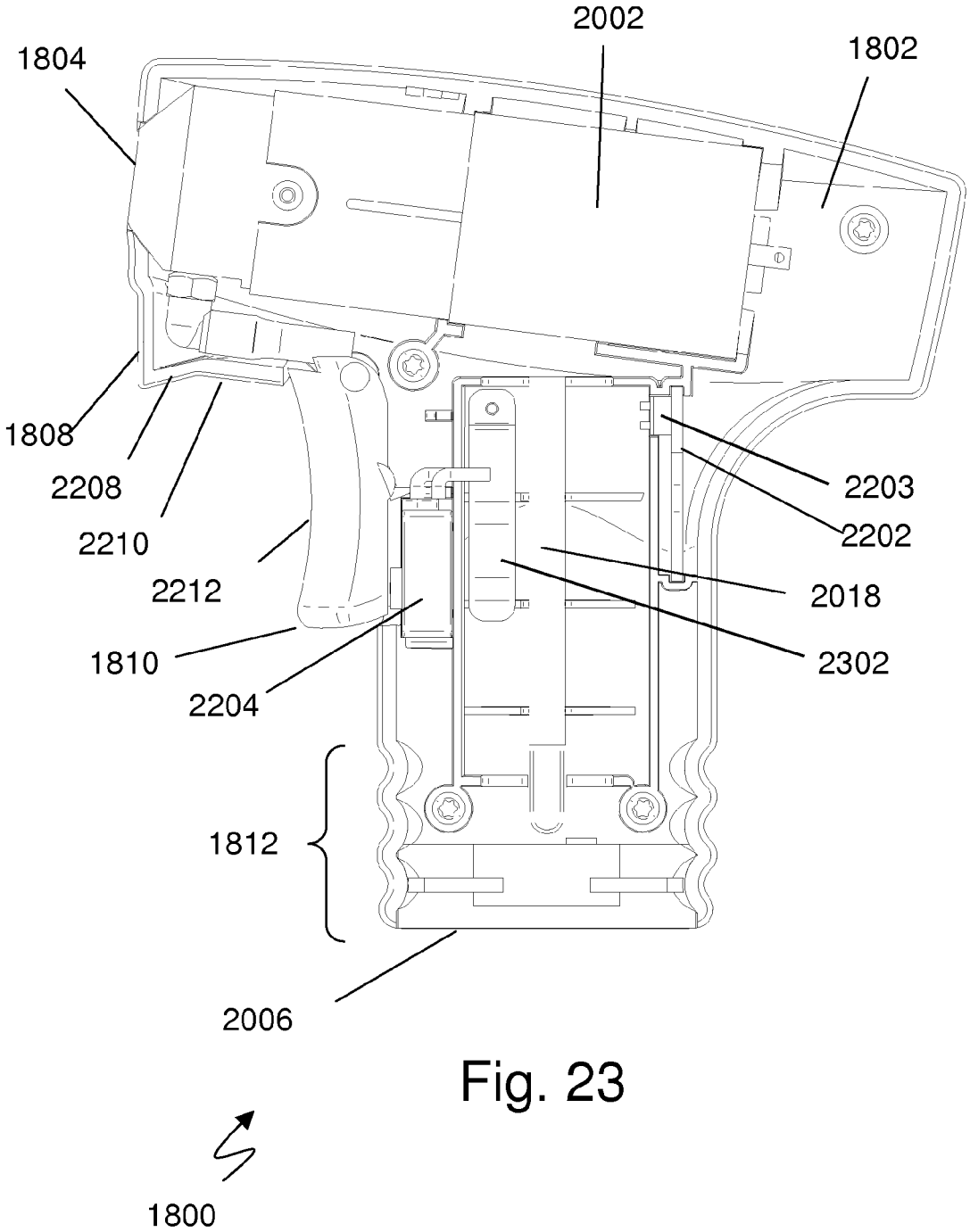
FIG. 23 is a left side view of the exemplary sprayer of FIG. 18 with the left shell and battery pack removed.

FIG. 23 is a left side view of the exemplary sprayer of FIG. 18 with the left shell and battery pack removed. FIG. 23 shows the battery compartment and path for the fluid tubing. The battery connector board 2202 and connector 2203 are shown.

Figure 24:
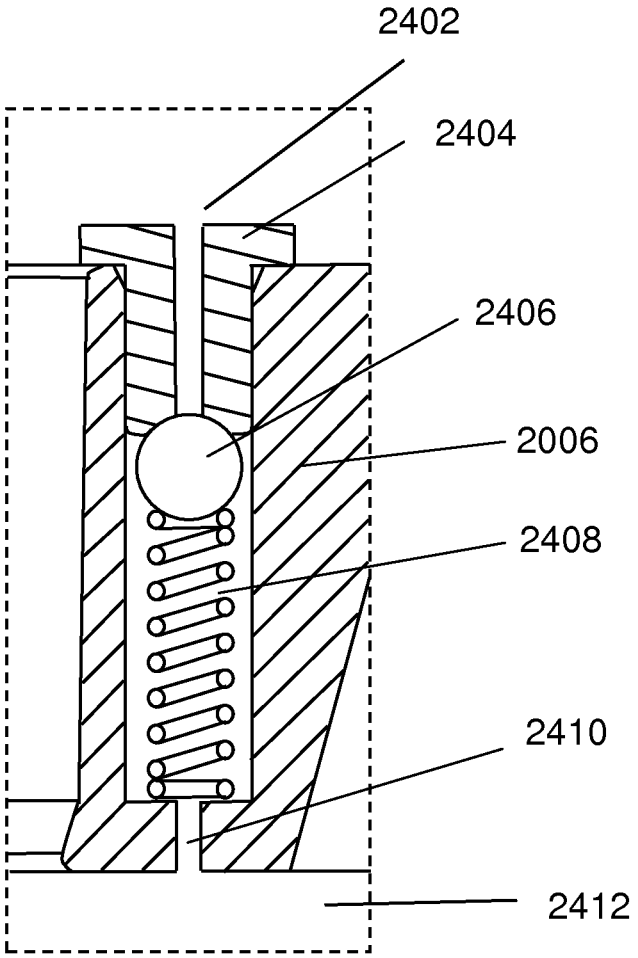
FIG. 24 is a detail drawing of a portion of the cross section of FIG. 22A showing an exemplary vent check valve embedded in a bottle interface cap.

FIG. 24 is a detail drawing of a portion of the cross section of FIG. 22A showing an exemplary vent check valve embedded in a bottle interface cap. The bottle should preferably be sealed to prevent flow of fluid out of the bottle for any orientation of the bottle. For example, if the bottle is tipped over and the fact is not observed for some time, most of the fluid may leak out creating a mess and possibly a fire hazard. Referring to FIG. 24, the vent check valve comprises a valve ball 2406 preloaded with a valve spring 2408 against a valve seat formed in a plug 2404. The plug 2404 is vented to the interior 2402 of the sprayer. As a vacuum forms in the interior of the bottle 2412, the vacuum is conducted through the valve 2410 and draws the valve ball 2406 down, opening the valve and allowing air to fill the bottle. The check valve prevents flow of fluid (oil) out of the bottle if the bottle is tipped over, while allowing air into the bottle as the fluid is used. Without a vent, the pump may collapse the bottle.

Figure 25:
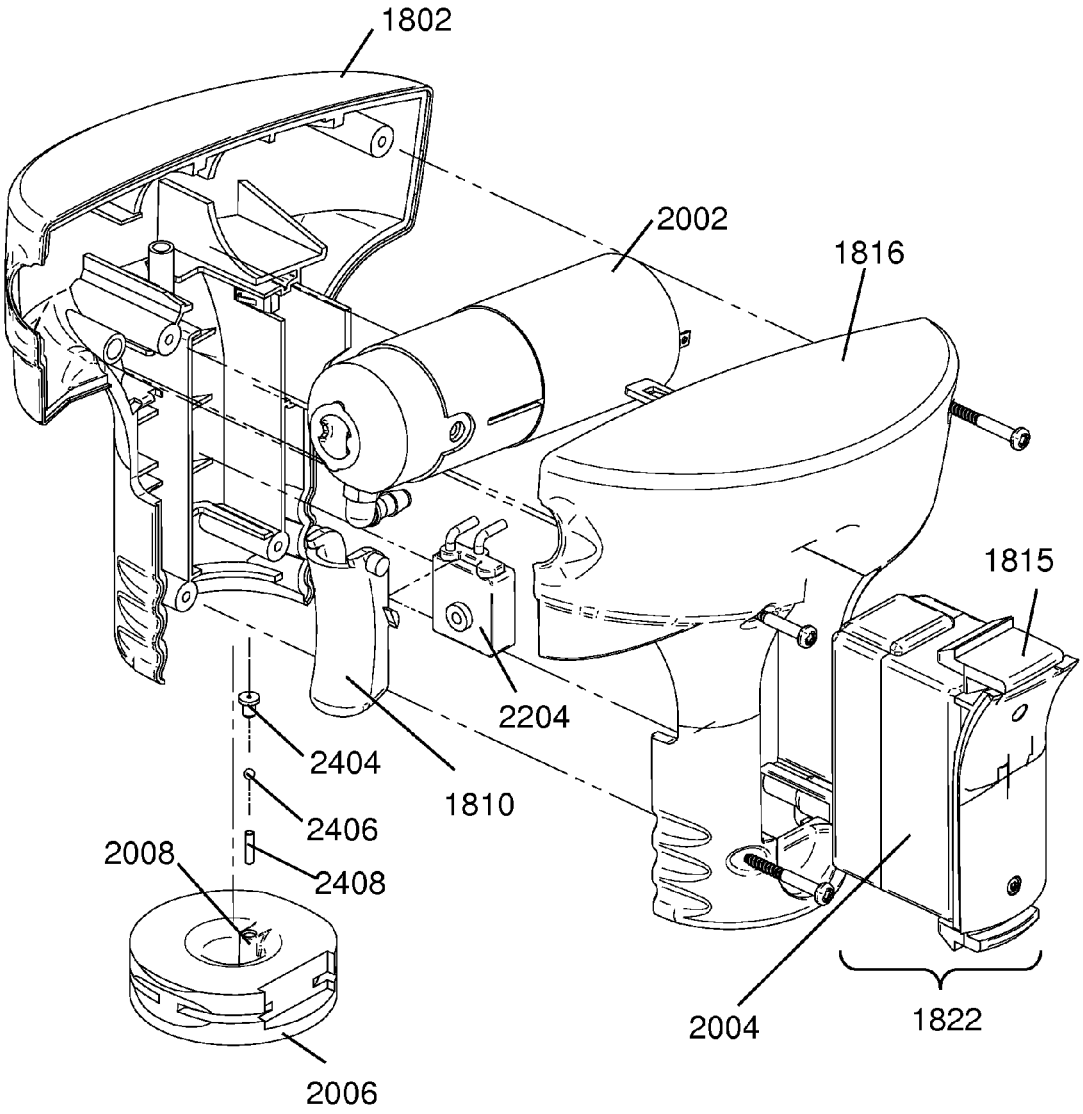
FIG. 25 is an exploded view of the exemplary sprayer head assembly of FIG. 18.

FIG. 25 is an exploded view of the exemplary sprayer head assembly of FIG. 18. FIG. 18 shows the right shell 1802, the left shell 1816, the integrated nozzle/pump assembly 2002, the trigger 1810, the switch 2204 and the battery module

1822. The battery module 1822 comprises the latch tabs 1814, 1815, the battery holder cover 2011, latch spring 2010, and battery itself 2004.

Figure 26:
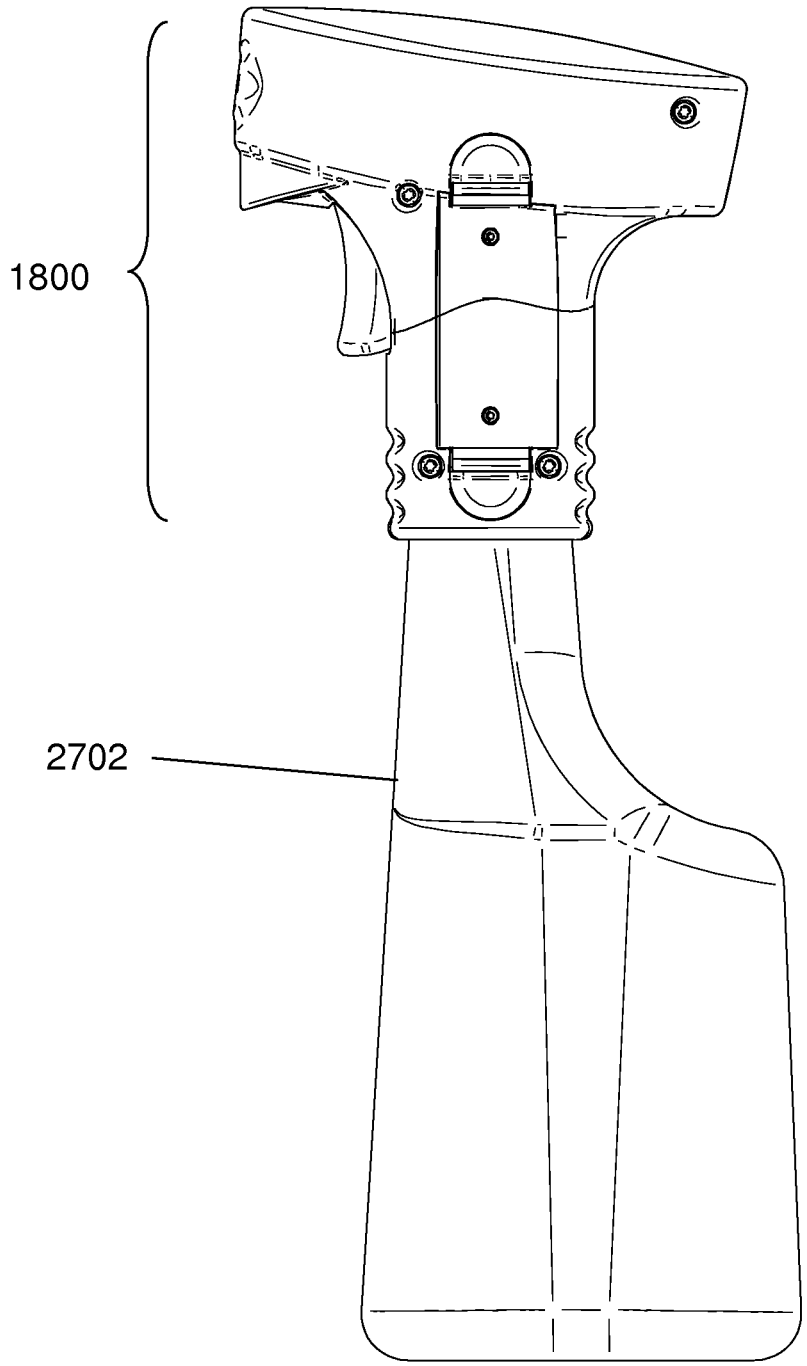
FIG. 26 is a right side elevational view of the exemplary sprayer head with a spray bottle.

FIG. 26 is a right side elevational view of the exemplary sprayer head with a spray bottle 2702. The spray bottle may preferably screw onto the sprayer head 1800; however, other attachments may be used, such as quick connect. Various bottle sizes may be used.

Figure 27:
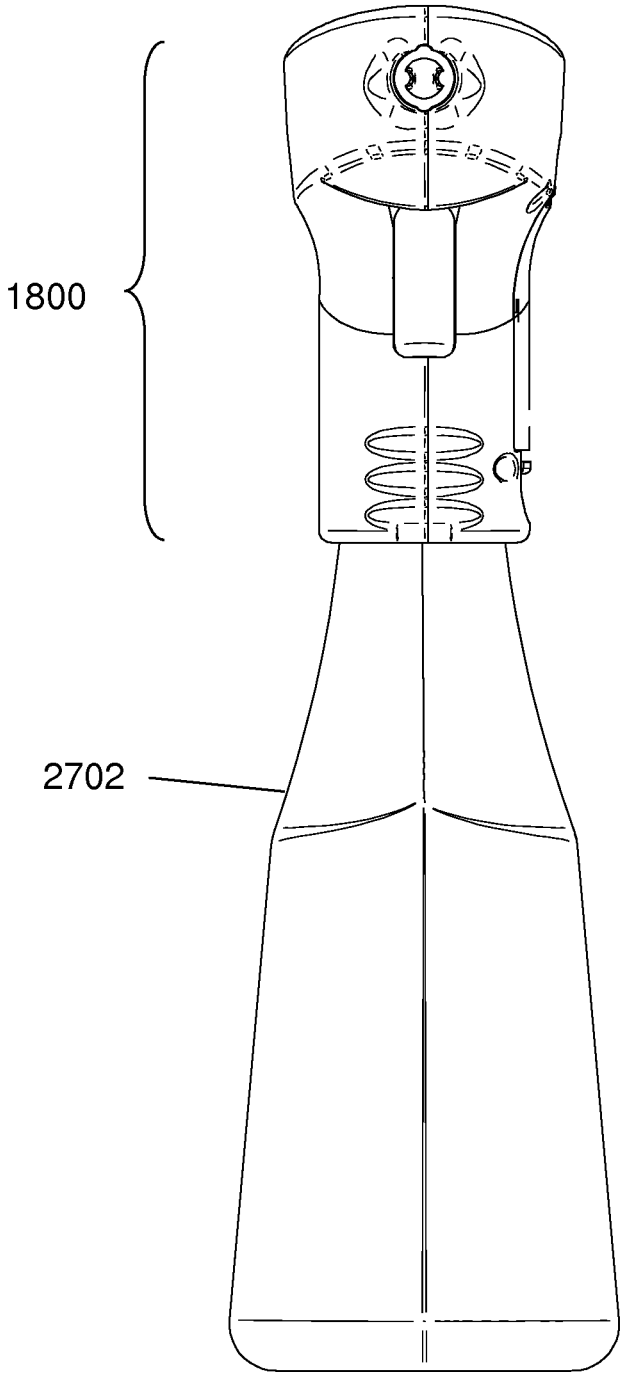
FIG. 27 is a front elevational view of the exemplary sprayer head with a spray bottle of FIG. 26.

FIG. 27 is a front elevational view of the exemplary sprayer head with the spray bottle of FIG. 26.

Figure 28:
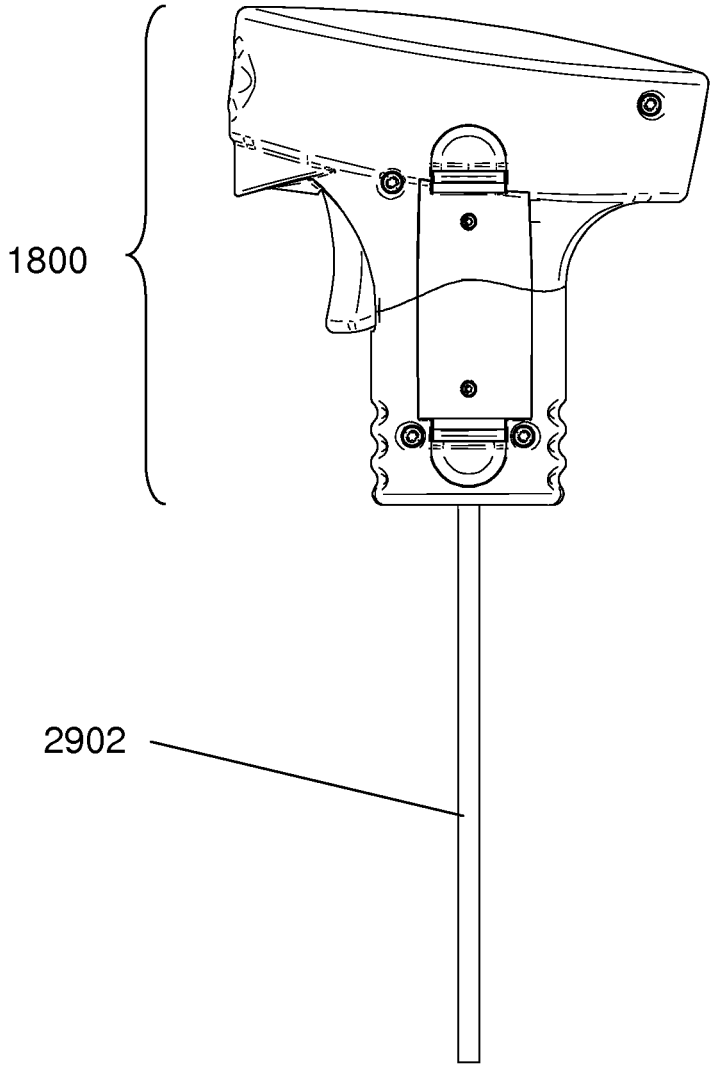
FIG. 28 is a right side elevational view of the exemplary sprayer head with a pickup tube installed.

FIG. 28 is a right side elevational view of the exemplary sprayer head with a pickup tube installed. The fluid pick up tube 2902 may be a straight tube as shown. Alternatively the tube may be bent and directed to a low point in the bottle. Alternatively, the tube may be flexible and may have a weight to gravitate to the lowest point of the bottle. The pickup tube may be open as shown or may have a filter screen installed.

Figure 29:
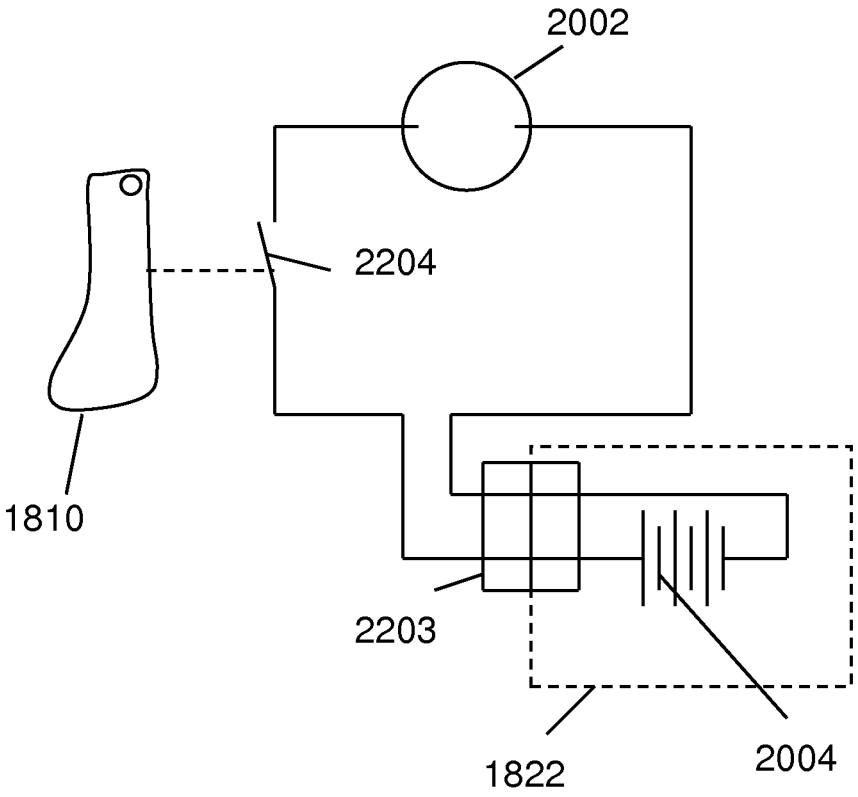
FIG. 29 is a schematic diagram of an exemplary control circuit for the sprayer of FIG. 18.

FIG. 29 is a schematic diagram of an exemplary control circuit for the sprayer of FIG. 18. Referring to FIG. 29, the trigger 1810 controls the switch 2204 to turn on or off the battery 2004 power supplied to the motor 2002 of the sprayer pump. Alternatively, the controller may be a variable speed controller.

Figure 30:
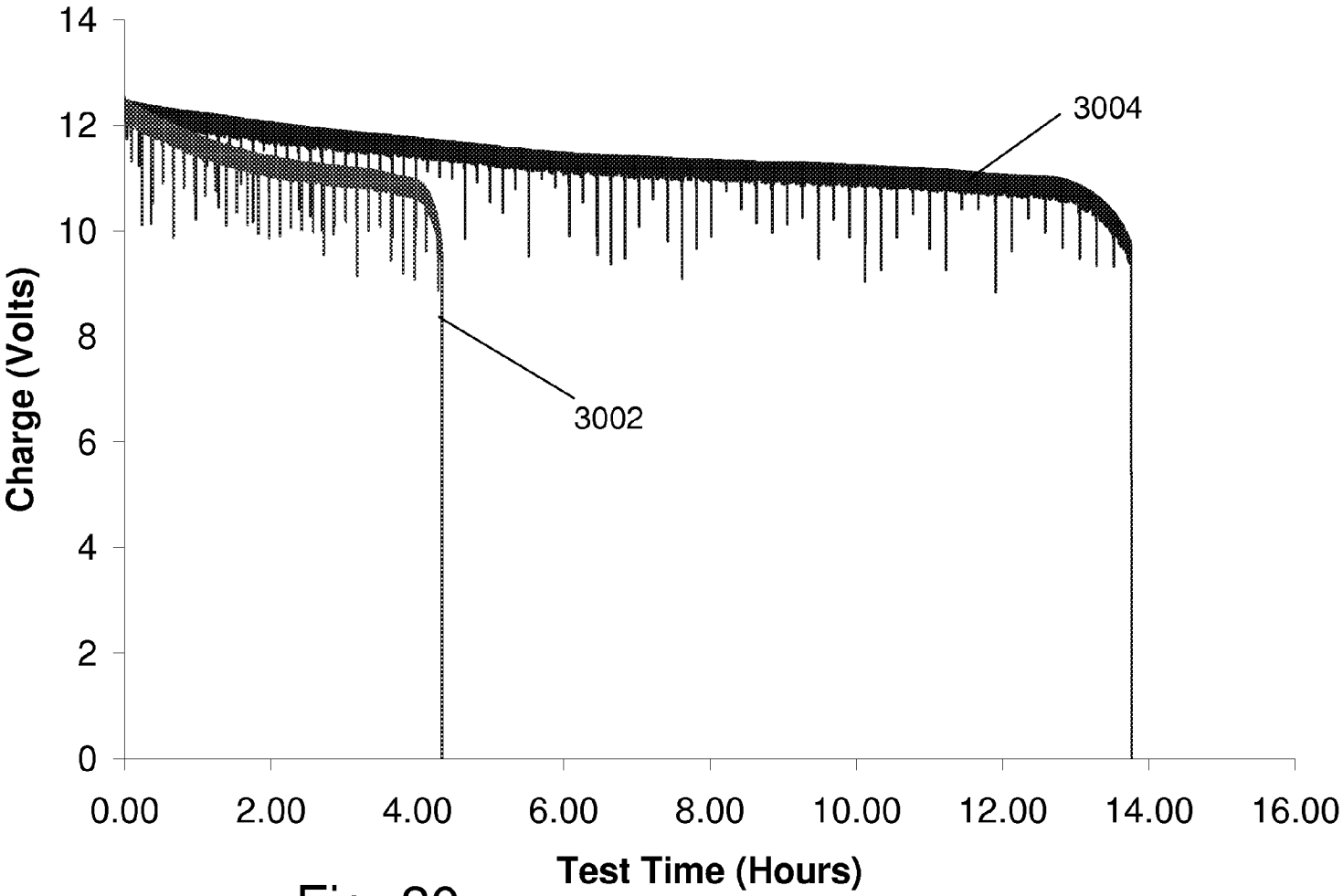
FIG. 30 shows the operational capability for two usage profiles.

FIG. 30 shows the operational capability for two usage profiles. The sprayer used for the test of FIG. 30 sprayed 100 ml/min oil with a 10 cm full width pattern at 30 cm distance using oil with a viscosity of about 50 centipoise.

The first profile 3002 is for a 30% duty cycle, 3 second trigger pulse (7 second "off" interval between trigger "on" pulses), resulting in 4.5 hours of use and 78 minutes of "on" time (total pulse time). The second profile is for a 10% duty cycle, 3 second trigger pulse (27 seconds "off" time between trigger pulses), resulting in 13.7 hours of intermittent use and 82.5 minutes of total "on" time. Note a slightly longer total "on" time for the lower duty cycle.

CONCLUSION

Relative terms such as "bottom" and "top" with respect to features shown in the drawings typically refer to the orientation of drawing features relative to the page and are for convenience of explanation only. The device itself may be operated in any orientation relative to gravity. In this disclosure, typical exemplary ranges may be provided. It is intended that ranges given include any sub-range within the provided range.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A power trigger sprayer for spraying a fluid having a viscosity of at least 20 centiStokes, said power trigger sprayer comprising:

a shell for housing components for said sprayer; said shell adapted for coupling to a fluid source container;

a pulsating pump capable of producing a pulsed flow at a varying flow rate for each pulse at a high pulse repetition rate, said high pulse repetition rate sufficient to maintain multiple pulses simultaneously in flight to develop a predetermined spray pattern;

said pulsating pump having a first piston and a second piston and a drive motor configured to provide two non-overlapping pulses of said pulsed flow for each revolution of said drive motor;

a swirl chamber nozzle configured for operation with said fluid, coupled to said pulsating pump through a coupling capable of delivering said pulsed flow without smoothing said pulsed flow;

a tube coupled to said pulsating pump for picking up said fluid from said fluid source container;

said fluid having a viscosity of at least 20 centiStokes;

a rechargeable power source configured as a removable power source module contained, at least in part, within a cavity formed by said shell, said rechargeable power source having a battery portion that, when in use, is disposed entirely within said cavity formed by said shell; and a trigger for controlling power to said pulsating pump from said power source.

2. The power trigger sprayer of claim 1, wherein said power trigger sprayer is capable of spraying 1 liter of said fluid having a viscosity of at least 20 centiStokes on a single charge from said power source.

3. The power trigger sprayer of claim 1, wherein said shell includes a grip section for holding said power trigger sprayer for hand held operation, and said power source module is contained, at least in part, within said grip section.

4. The power trigger sprayer of claim 1, wherein said high pulse repetition rate is sufficient for a portion of the flow from a following pulse to overtake a portion of the flow from a preceding pulse before reaching a distance of 30 centimeters.

5. The power trigger sprayer of claim 3, wherein said power source module comprises a first latching grip tab on a first end of said power source module and a second latching grip tab on a second end of said power source module, said second end opposite said first end, said first latching grip tab and said second latching grip tab configured to unlatch said power source module when depressed toward one another and release said power source module from said power trigger sprayer, said first latching grip tab and said second latching grip tab having sufficient grip surface to enable gripping and removing said power source module using two fingers of one hand in contact with said first latching grip tab and said second latching grip tab;

said first latching grip tab and said second latching grip tab each disposed within a respective recess in said power trigger sprayer allowing finger access to said first latching grip tab and said second latching grip tab; and said first latching grip tab and second latching grip tab disposed vertically relative to one another on a same side of said power trigger sprayer.

6. The power trigger sprayer of claim 1, wherein said first piston and said second piston are connected to said swirl chamber through separate respective feeds entering said swirl chamber on opposite sides of said swirl chamber.

7. The power trigger sprayer of claim 5, wherein said power source module spans from above said grip section to a point below said trigger.

8. The power trigger sprayer of claim 7, said power source module laterally centered in said grip section.

9. The power trigger sprayer of claim 1, wherein said varying flow rate is from zero to a maximum flow rate for each pulse.

10. The power trigger sprayer of claim 9, wherein said varying flow rate of each pulse is characterized by a sine function.

11. The power trigger sprayer of claim 10, wherein said pulse repetition rate is at least 3000 pulses per minute.

12. The power trigger sprayer of claim 9, wherein said fluid is a fluid with a kinematic viscosity greater than 30 centiStokes.

13. The power trigger sprayer in accordance with claim 12, wherein said swirl chamber nozzle comprises a cylindrical swirl chamber having a tangential feed at an input end and a flat surface opposite the input end, said flat surface having an exit aperture leading through a throat section to a conical nozzle recess, wherein said cylindrical swirl chamber has a length to diameter ratio of between 0.4 and 0.6, and said throat section has a length to diameter ratio of less than 0.25.

14. The power trigger sprayer in accordance with claim 13, wherein said swirl chamber exit aperture comprises a knife edge circumference.

15. The power trigger sprayer of claim 13, wherein the nozzle recess has an initial cone angle at the nozzle of greater than 45 degrees half angle.

16. A method for spraying viscous fluid comprising:

providing an integrated swirl chamber nozzle, pump, and motor assembly;

forming a sprayer head by housing the integrated swirl chamber nozzle, pump, and motor assembly in a cordless hand held case with a power source and trigger switch, said pump comprising two pistons configured to deliver two separate pulses per revolution of said motor;

said swirl chamber nozzle comprising a cylindrical swirl chamber having a tangential feed at an input end and a flat surface opposite the input end, said flat surface having an exit aperture leading through a throat section to a conical nozzle recess, said cylindrical swirl chamber having a length to diameter ratio of between 0.4 and 0.6, and said throat section having a length to diameter ratio of less than 0.25;

adapting the sprayer head for attaching a fluid reservoir and receiving said viscous fluid from said fluid reservoir;

pulsing a fluid flow to the nozzle at a high pulse rate in response to said trigger switch, said high pulse rate sufficient to maintain multiple fluid pulses simultaneously in flight to develop a predetermined spray pattern; and configuring the sprayer head with a drip shield below the nozzle configured for directing drip flow away from the trigger switch to a low point forward of the trigger switch and above at least part of the trigger switch.

17. The method of claim 16, further comprising the step:

providing a power source module within a grip section of said case, said battery power source module occupying a cross section having an area at least 50% of the area of the cross section of the grip section;

wherein said power source module comprises a first latching grip tab on a first end of said power source module and a second latching grip tab on a second end of said power source module, said second end opposite said first end, said first latching grip tab and said second latching grip tab configured to unlatch said power source module when depressed toward one another and release said power source module from said power trigger sprayer, said first latching grip tab and said second latching grip tab having sufficient grip surface to enable gripping and removing said power source module using two fingers of one hand in contact with said first latching grip tab and said second latching grip tab;

said power source module having a battery portion that, when in use, is disposed entirely interior to a cavity formed by said grip section of said case of said sprayer head;

said first latching grip tab and said second latching grip tab each disposed within a respective recess in said sprayer head allowing finger access to said first latching grip tab and said second latching grip tab; and said first latching grip tab and second latching grip tab disposed vertically relative to one another on a same side of said sprayer head.

18. The method in accordance with claim 16, wherein the drip shield is at least 2 cm forward of said trigger switch.

19. The method in accordance with claim 16, wherein said predetermined pattern is developed at a distance of at least 30 centimeters.

20. The method in accordance with claim 17, further including steps:

1) gripping said power source module by gripping at least one said latching grip tab;

2) removing said battery module from said sprayer while holding said at least one latching grip tab;

3) placing said battery module in a charger;

wherein steps 1), 2), and 3) are performed without releasing the grip on the battery module.

21. The power trigger sprayer in accordance with claim 12, wherein said pulse rate is at least 6000 pulses per minute.

22. The power trigger sprayer in accordance with claim 21, wherein said coupling from said swirl chamber to said pulsating pump consists of material at least as rigid as material used for said cylinder.

23. A power trigger sprayer comprising:

a shell for housing components for said sprayer; said shell adapted for coupling to a fluid source container;

a pulsating pump capable of producing a varying flow rate at a high pulse rate, said high pulse rate sufficient to maintain multiple pulses simultaneously in flight to develop a predetermined spray pattern;

a swirl chamber nozzle coupled to said pulsating pump;

a tube coupled to said pulsating pump for picking up fluid from said fluid source container;

a rechargeable power source module contained, at least in part, within said shell;

said shell having a cavity in a grip section thereof, said cavity having an opening for insertion of said power source module, in operation, a battery portion of said rechargeable power source being entirely beyond said opening and interior to said cavity;

a trigger for controlling power to said pulsating pump from said power source;

wherein said power source module comprises a first latching grip tab on a first end of said power source module and a second latching grip tab on a second end of said power source module, said second end opposite said first end, said first latching grip tab and said second latching grip tab configured to unlatch said power source module when depressed toward one another and release said power source module from said power trigger sprayer, said first latching grip tab and said second latching grip tab having sufficient grip surface to enable gripping and removing said power source module using two fingers of one hand in contact with said first latching grip tab and said second latching grip tab;

said first latching grip tab and said second latching grip tab each disposed within a respective recess in said power trigger sprayer allowing finger access to said first latching grip tab and said second latching grip tab; and said first latching grip tab and second latching grip tab disposed vertically relative to one another on a same side of said power trigger sprayer.

* * * * *